US009221275B2

(12) United States Patent
Till

(10) Patent No.: US 9,221,275 B2
(45) Date of Patent: Dec. 29, 2015

(54) METHOD OF PRINTING A PICTORIAL IMAGE ONTO THE CIRCUMFERENTIAL OUTER SURFACE OF BEVERAGE BOTTLES AND FILLING BEVERAGE BOTTLES IN A BOTTLING PLANT FOR FILLING BOTTLES WITH A LIQUID BEVERAGE FILLING MATERIAL IN ROTARY FILLING MACHINERY AND APPARATUS THEREFOR

(75) Inventor: Volker Till, Hofheim/Taunus (DE)

(73) Assignee: KHS GmbH, Dortmund (DE)

( * ) Notice: Subject to any disclaimer, the term of this patent is extended or adjusted under 35 U.S.C. 154(b) by 1006 days.

(21) Appl. No.: 12/370,764

(22) Filed: Feb. 13, 2009

(65) Prior Publication Data

US 2009/0145511 A1 Jun. 11, 2009

Related U.S. Application Data

(63) Continuation of application No. 11/621,833, filed on Jan. 10, 2007, now abandoned.

(30) Foreign Application Priority Data

Jan. 10, 2006 (DE) ..... 10 2006 001 223

(51) Int. Cl.

| | |
|---|---|
| ***B65B 61/02*** | (2006.01) |
| ***B41J 3/407*** | (2006.01) |
| ***B41J 2/06*** | (2006.01) |
| ***B65B 61/26*** | (2006.01) |
| *B41J 11/00* | (2006.01) |

(52) U.S. Cl.

CPC *B41J 3/4073* (2013.01); *B41J 2/06* (2013.01); *B65B 61/26* (2013.01); *B41J 11/002* (2013.01)

(58) Field of Classification Search

CPC ..... B65B 61/01; B65B 61/025; B65B 61/26; B41F 17/22; B41J 2/41; B41J 2/06; B41J 3/4073; B41J 11/002

USPC ..... 53/253, 331.5, 317, 319, 248, 431, 411, 53/131.2–131.4; 101/35, 38.1, 36, 39, 40, 101/40.1; 347/112, 141, 147, 20, 37, 38, 347/40, 47, 55

See application file for complete search history.

(56) References Cited

U.S. PATENT DOCUMENTS 2,707,044 A * 4/1955 Steck ..... 198/378
3,276,356 A * 10/1966 Usko et al. ..... 101/40

(Continued)

FOREIGN PATENT DOCUMENTS

DE 698 11 683 T2 12/2003
EP 01 08 683 5/1984

(Continued)

*Primary Examiner* — Stephen F Gerrity
*Assistant Examiner* — Joy N Sanders
(74) *Attorney, Agent, or Firm* — Nils H. Ljungman & Associates

(57) ABSTRACT

A container-printing arrangement configured to print graphic, numeric, and/or alpha-numeric information or an image on an external surface of a bottle or similar container. The arrangement comprises at least one electrostatic print head having a plurality of openings configured to dispense printing liquid and a plurality of corresponding electrodes. The openings are located in a row one after another along a print head longitudinal axis. A container handling arrangement is used to position a container adjacent the at least one electrostatic print head to permit dispensing of printing liquid onto an external surface of the container.

19 Claims, 18 Drawing Sheets

(56) References Cited

U.S. PATENT DOCUMENTS

| | | | | | |
|---|---|---|---|---|---|
| 4,412,232 | A | * | 10/1983 | Weber et al. | 347/68 |
| 4,502,054 | A | * | 2/1985 | Brescia et al. | 347/55 |
| 5,190,384 | A | * | 3/1993 | Speicher | 400/128 |
| 5,227,005 | A | | 7/1993 | Zodrow et al. | |
| 5,317,967 | A | * | 6/1994 | Heidenreich | 101/38.1 |
| 5,713,403 | A | | 2/1998 | Clusserath et al. | |
| 5,790,151 | A | * | 8/1998 | Mills | 347/47 |
| 6,033,053 | A | * | 3/2000 | Eun | 347/38 |
| 6,158,844 | A | * | 12/2000 | Murakami et al. | 347/55 |
| 6,302,529 | B1 | * | 10/2001 | Tajima | 347/55 |
| 6,769,357 | B1 | * | 8/2004 | Finan | 101/38.1 |
| 2003/0093171 | A1 | | 5/2003 | Soehnlen | |
| 2006/0214993 | A1 | * | 9/2006 | Iwata | 347/52 |

FOREIGN PATENT DOCUMENTS

| | | | |
|---|---|---|---|
| EP | 0108683 | A1 | 5/1984 |
| EP | 0 209 896 | | 1/1987 |
| EP | 0 385 624 | A1 | 9/1990 |
| EP | 08 13 965 | | 12/1997 |
| EP | 0813965 | A2 | 12/1997 |
| EP | 10 38 782 | | 9/2000 |
| EP | 1038782 | A1 | 9/2000 |
| EP | 1 225 053 | A2 | 7/2002 |
| EP | 1 243 425 | | 9/2002 |
| EP | 1 225 053 | A3 | 5/2003 |
| EP | 14 35 296 | | 7/2004 |
| EP | 1435296 | A1 | 7/2004 |
| JP | 2185444 | A | 7/1990 |
| JP | 2001-315292 | A | 11/2001 |
| JP | 2001347656 | A | 12/2001 |
| JP | 2003-123130 | A | 4/2003 |
| JP | 2005-531428 | T | 10/2005 |
| WO | WO 2004/007094 | | 1/2004 |
| WO | WO 2004/009360 | | 1/2004 |
| WO | WO 2004007094 | A1 | 1/2004 |

* cited by examiner

Docket No.: NHL-HOL-149A-C
Serial No.: 12/370,764
REPLACEMENT SHEET

METHOD OF PRINTING A PICTORIAL IMAGE ONTO THE CIRCUMFERENTIAL OUTER SURFACE OF BEVERAGE BOTTLES AND FILLING BEVERAGE BOTTLES IN A BOTTLING PLANT FOR FILLING BOTTLES WITH A LIQUID BEVERAGE FILLING MATERIAL IN ROTARY FILLING MACHINERY AND APPARATUS THEREFOR

BACKGROUND

1. Technical Field

This application relates to a method of printing a pictorial image onto the circumferential outer surface of beverage bottles and filling beverage bottles in a bottling plant for filling bottles with a liquid beverage filling material in rotary filling machinery and apparatus therefor.

2. Background Information

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

Some beverage bottling plants may possibly comprise filling arrangements that receive a liquid beverage material from a toroidal or annular vessel, in which a supply of liquid beverage material is stored under pressure by a gas. The toroidal vessel may also be connected to at least one external reservoir or supply of liquid beverage material by a conduit or supply line. In some circumstances it may even be possible that a beverage bottling plant has two external supply reservoirs, each of which may be configured to store either the same liquid beverage product or different products. These reservoirs could possibly be connected to the toroidal or annular vessel by corresponding supply lines, conduits, or other arrangements. It is also possible that the external supply reservoirs could be in the form of simple storage tanks, or in the form of liquid beverage product mixers.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

In some beverage bottling plants, an information adding station comprises devices or machines that work in clocked cycles for the direct imprinting of containers, in particular in the form of glass or plastic bottles, for example to apply information and/or advertising so that it is permanent and cannot be detached from the container. The printing is generally done either using a screen-printing process or by pad printing.

There are also methods and devices in which information is applied directly to bottles by digitally controlled ink jet printing or digital printing. Some devices of this type are known under the name "Videojet," for example. In one method, printed dots are produced continuously, which in the standard case are deflected, while only for the actual printing can individual drops of ink pass through the outlet nozzle, allowing them to reach the surface of the bottle where they produce a printed image. The width of the printed character is thereby equal to the height of the character, so that only lines the width of which is equal to the height of the characters can be printed on the respective container or bottle.

There are also ink jet printers with ink jet print heads, for office use among other things, which during the printing produce a linear impression that comprises individual dots and the height of which equals the height of a letter. During the printing, a relative movement between the print head and the surface, such as a sheet of paper, to be printed is necessary in two axial directions that are perpendicular to each other, and namely by moving the print head in the one direction, for example in the horizontal direction, and by moving the surface to be printed in the other axial direction.

There is also an existing method and a print head with which a plurality of printed dots can be produced in a line very close to one another or at a very small distance from one another, for example at least 150 dots per inch, on a surface to be printed, and specifically by a plurality of individually activated individual ink jets. The active print width of this print head, which is also known by the name "Tonejet", is a function only of the performance of the computer that actuates the print head. For example, print heads from 1.7 to 6.8 inch print width, corresponding to a 256 Bit control or a 1024 Bit control, can thereby be produced. Using this print head, it is possible to print a two-dimensional impression with a sufficiently large surface area only in a single axial direction by relative motion between the surface to be printed and the print head.

OBJECT OR OBJECTS

An object of at least one possible embodiment is to create a device for the application of information and/or images onto container surfaces that is as mechanically simple as possible, is as little susceptible to disruption as possible and can be operated at a high output capacity, whereby the orientation of the information can be selected as desired with respect to the geometry of the container. Another object of at least one possible embodiment is to describe at least one device with which printing is possible, including the direct imprinting of bottles or similar containers, such as on a rotationally symmetrical surface, with high print quality and high speed of the number of containers printed per unit of time. An additional object of at least one embodiment is to describe a device with which it is possible to print containers with surfaces that are not rotationally symmetrical, such as printing of containers with rectangular, triangular, polygonal or oval cross sections surfaces.

SUMMARY

At least one possible embodiment teaches that the containers and the device to apply information to the containers are realized so that they can be moved in relation to each other.

Another possible embodiment of the present application may be realized in a device for imprinting bottles or similar containers on their container external surfaces, with at least one printer station having at least one print head, wherein at least one print head is an electrostatic print head with a plurality of individually actuatable individual nozzles for controlled dispensing of ink, and that individual nozzles are essentially located in rows one after another in a print head longitudinal axis.

In one example, an individual printed image could be achieved purely digitally by a corresponding actuation of at least one print head or of individual nozzles of a print head with data stored in a computer memory. Thus, print masks of the type that are required in other existing printing methods commonly used to print large areas on the surface of containers, in particular also when screen printing or pad printing methods are used, would not be required. Among other things, this feature could significantly reduce the technical effort and expense of the method and also creates the possibility of modifying the impression or the printed image quickly and easily, including while a work process is running.

At least one possible embodiment of a device used to add information and/or images to a container or bottle could have at least one print head which is possibly a Tonejet print head or a print head that corresponds to such a Tonejet print head, such that in a printing area, it has a plurality of individual nozzles which are essentially arranged one behind another at substantially very close intervals in the longitudinal axis of the print head. It is also conceivable that each nozzle could be formed by a nozzle opening and by at least one electrode associated with each individual nozzle. In at least one embodiment, printing ink, or other printing substance, in a print head exits each individual nozzle or a corresponding nozzle opening essentially only if, during an activation process of an individual nozzle, an electrode associated with a corresponding nozzle is actuated by an electrical voltage. In one possibility, the polarity and/or potential of which differs from the polarity and/or the potential of the print head or of the ink in the print head, so that as a result of electrostatic forces, a defined quantity of ink is effectively ejected or discharged from the nozzle opening of the activated individual nozzle. A print head of this type is also called an "electrostatic print head".

Containers within the meaning of the present application include but are not limited to bottles, cans or packages, whereby essentially all the containers can have a cylindrical, non-cylindrical, rotationally symmetrical, or non-rotationally symmetrical shape and/or peripheral surface.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment is explained in greater detail below with reference to the exemplary embodiments that are illustrated in the accompanying figures. In the figures.

DESCRIPTION OF EMBODIMENT OR EMBODIMENTS

Developments, advantages and potential applications of at least one possible embodiment will become apparent on the basis of the following description of the exemplary embodiments and of the accompanying drawing. All the characteristics described and/or illustrated are the object or objects of the invention, individually or in any possible combination, regardless of their placement in the claims or the references between claims. The text of the claims is simultaneously incorporated by reference into the description.

Figure 1:
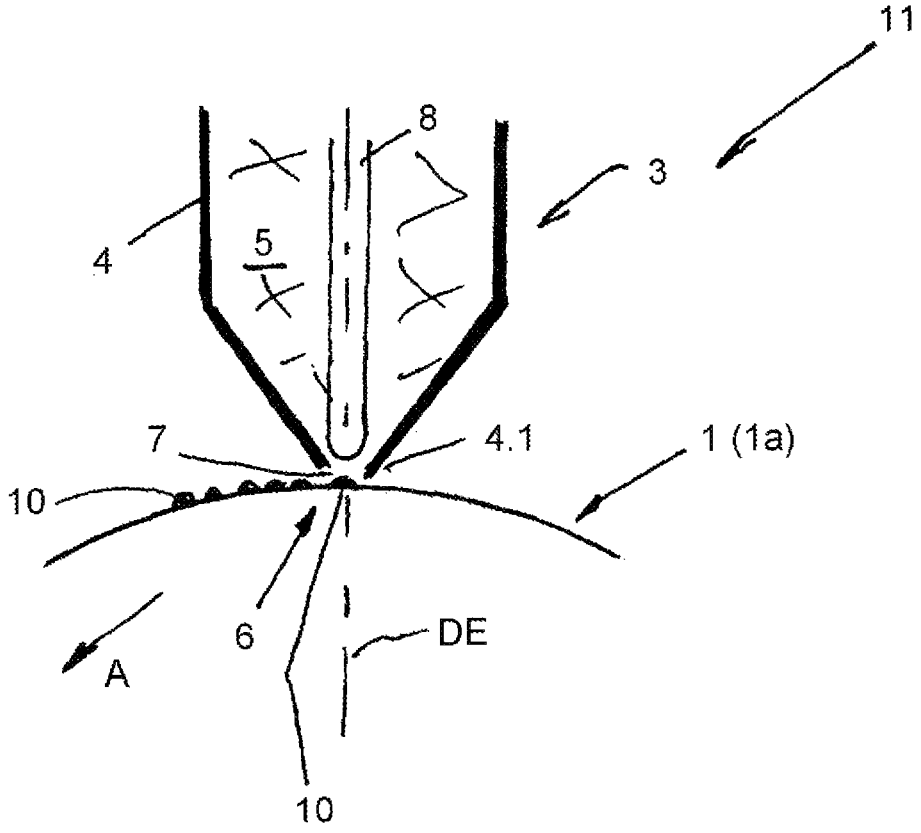
FIGS. 1 and 2 are schematic illustrations showing an electrostatic print head in partial section and in a lateral view, and specifically together with a container in the form of a glass or plastic bottle which is to be printed.
Figure 1A:
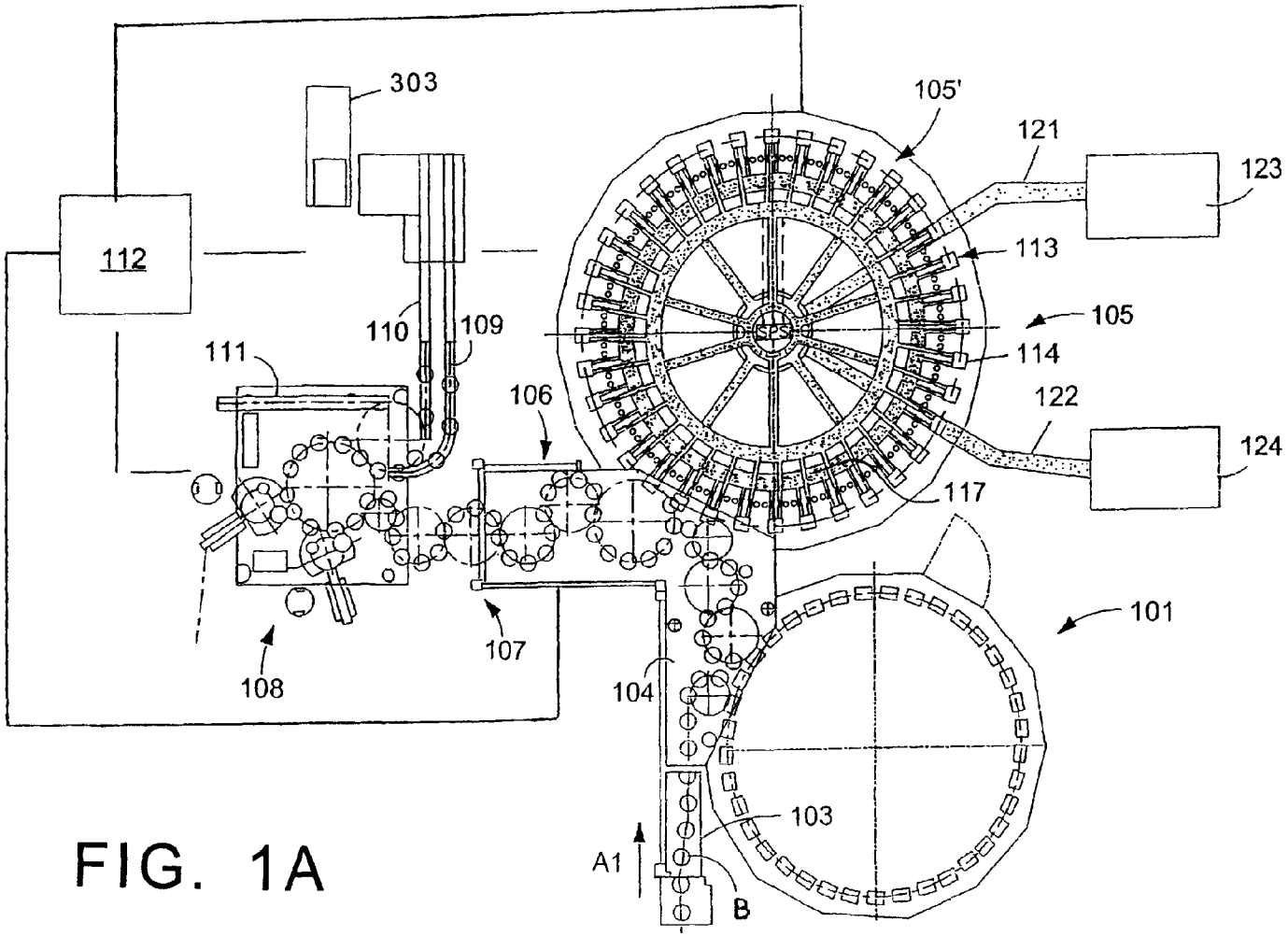
FIG. 1A shows schematically the main components of one possible embodiment example of what may be a typical system for filling containers.

FIG. 1A shows schematically the main components of one possible embodiment example of what may be a typical system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

After sorting, bottles B that are ready to be packed can be directed to a packing or packaging station 303 and packaged for shipment out of the plant.

The beverage bottling plant can be controlled by a central control arrangement 112, which could be, for example, computerized control system that monitors and controls the operation of the various stations and mechanisms of the beverage bottling plant.

In the figures, reference numeral 1 indicates containers, such as bottles, for example glass or plastic bottles or PET bottles, which are to be provided on their external surfaces directly with an at least one-color printed image 2.

Figure 1B:
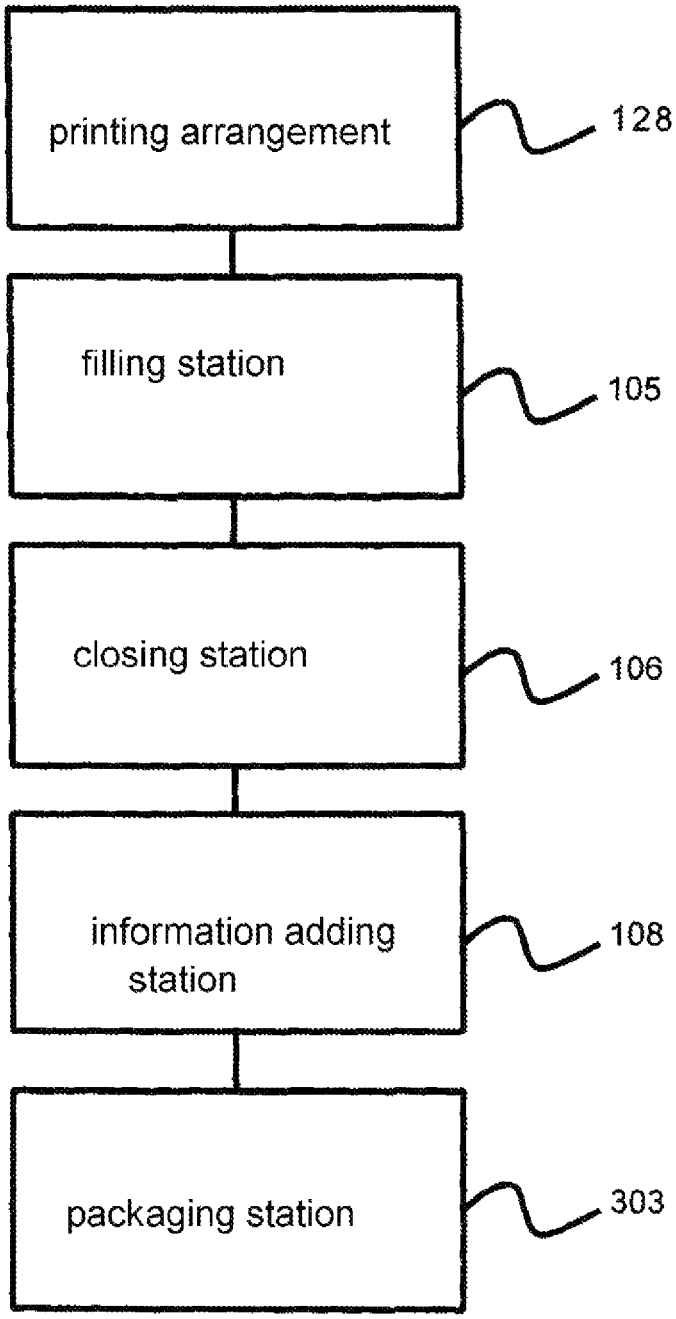
FIGS. 1B-1F are block diagrams which show additional possible variations of the arrangement of components shown in FIG. 1A.

FIGS. 1B through 1F show possible variations of the arrangements of essentially main components of one possible embodiment example of what may be a typical system for filling containers. FIG. 1B shows a printing arrangement 128 preceding the filling station 105. In at least one possible embodiment of the present application, containers could be provided with a printed image and/or printed information on their external surface before being filled.

Figure 1C:
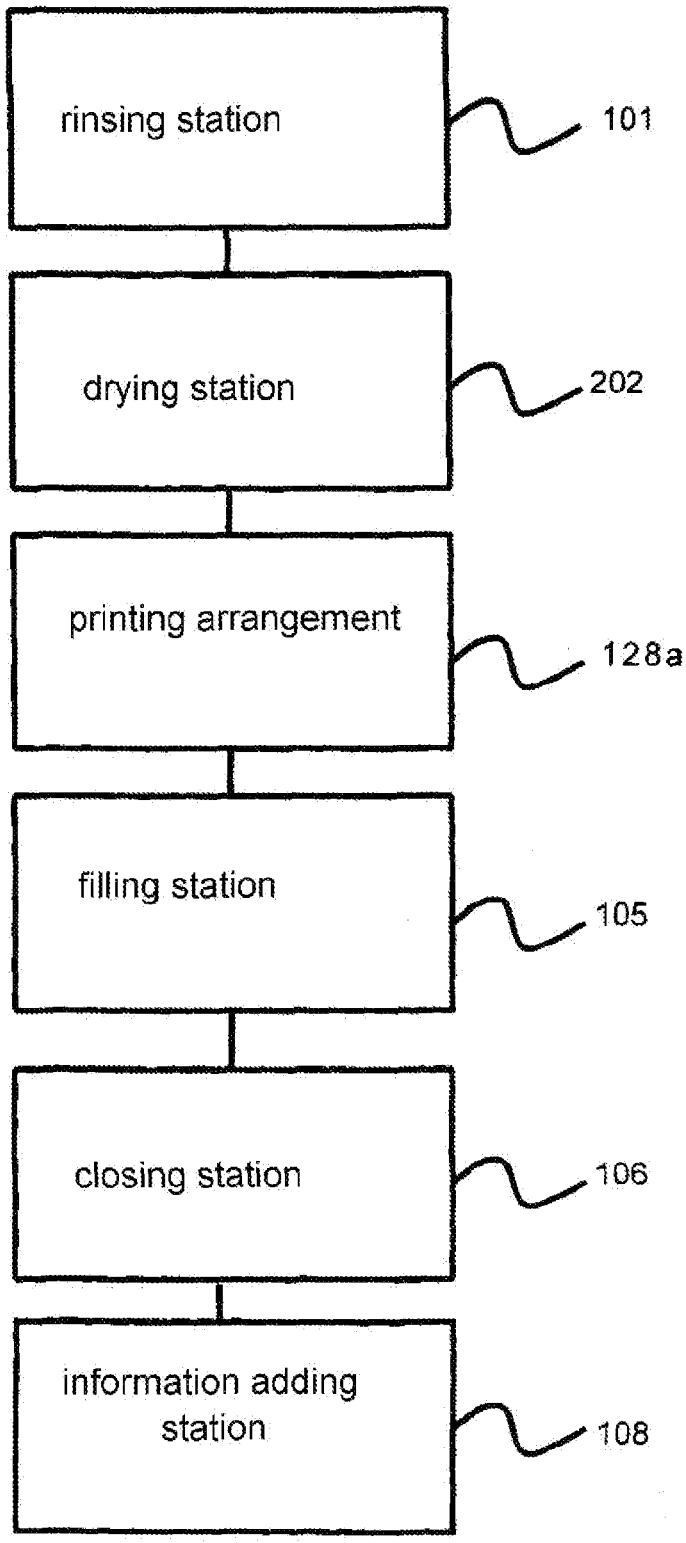

FIG. 1C shows a printing arrangement 128*a* located after the rinsing station 101 and drying station 202, and before the filling station 105. In at least one possible embodiment example, containers could be rinsed and dried prior to being provided with a printed image and/or printed information on their external surface and then subsequently filled.

Figure 1D:
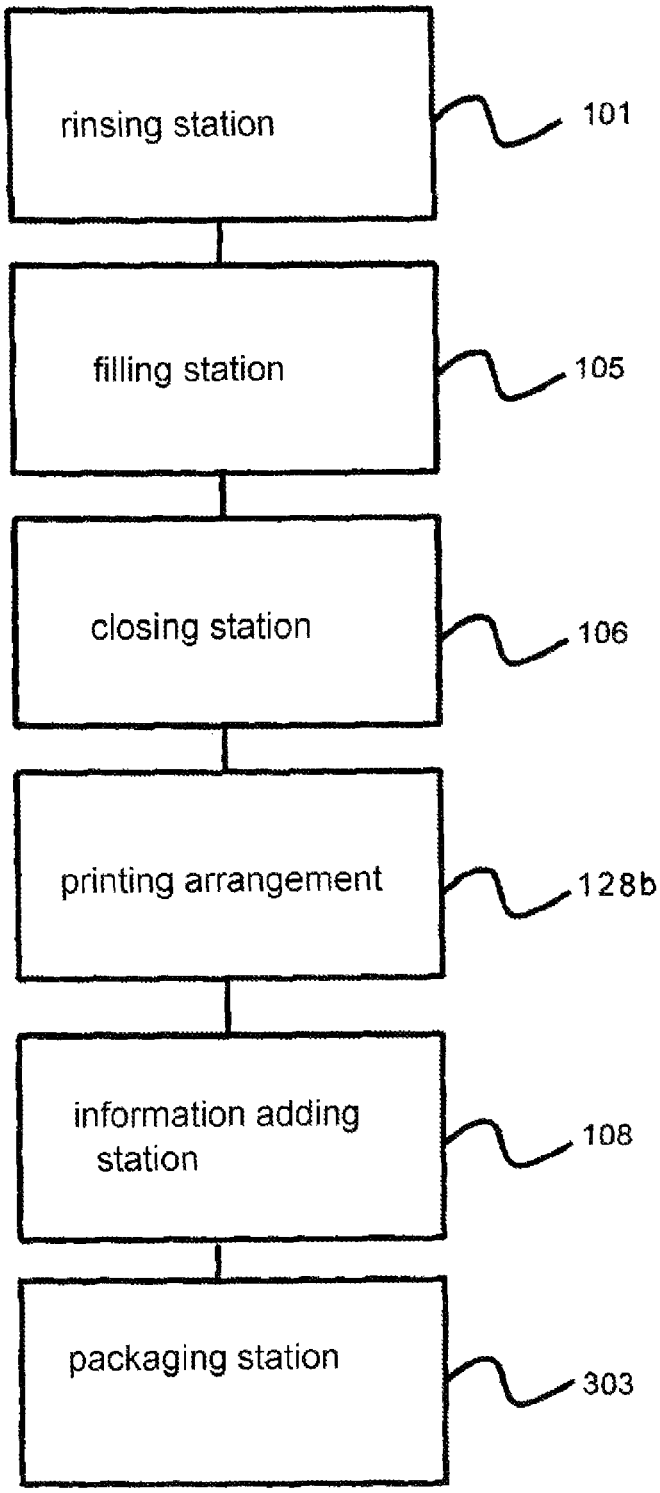

FIG. 1D shows a printing arrangement 128*b* located after the filling station 105 and closing station 106, and before the information adding station 108. In at least one possible embodiment example, containers could be filled and closed prior to being provided with a printed image and/or printed information on their external surface and then subsequently labeled.

Figure 1E:
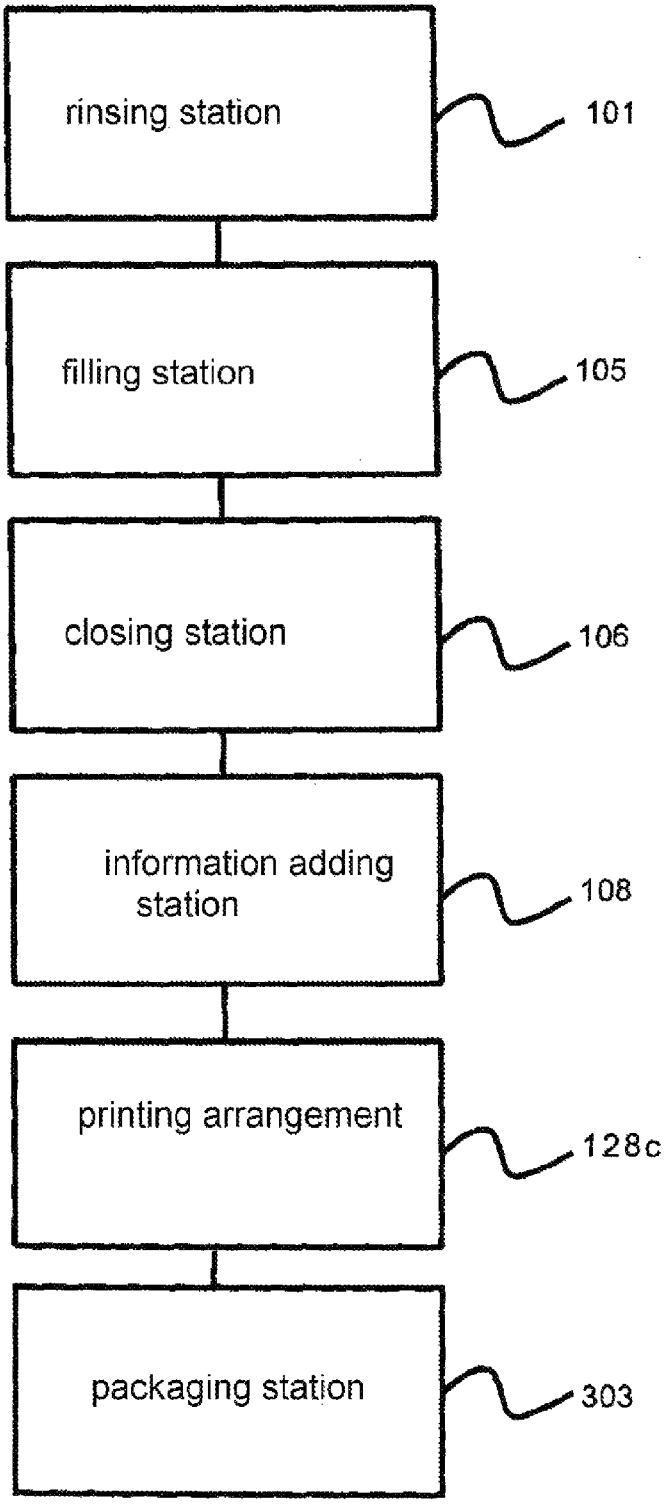

FIG. 1E shows a printing arrangement 128*c* located after the information adding station 108. In at least one possible embodiment example, containers could be labeled prior to being provided with a printed image and/or printed information on their external surface.

Figure 1F:
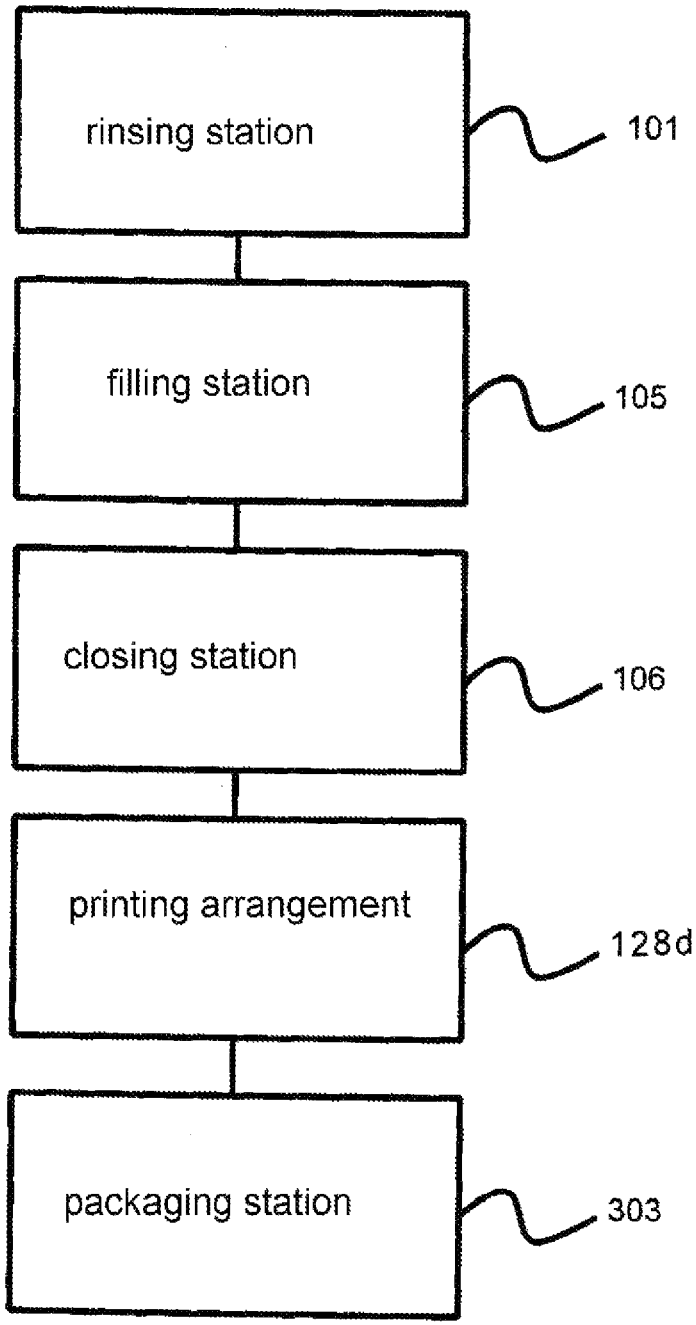

FIG. 1F shows a printing arrangement 128*d* located after the filling station 106 and before the packaging station 303. In at least one possible embodiment example, containers could be provided with a printed image and/or printed information on their external surface solely, wherein an information adding station may not be desired.

In at least one possible embodiment new, non-return and/or return containers may be provided with a printed image and/or printed information on their external surface. In at least one possible embodiment, when adding information to new non-return containers, a rinsing arrangement or drying arrangement may not be appropriate. It is also possible that return containers may have existing images and/or printed information on their external surface when upon entering a beverage bottling plant.

Figure 1G:
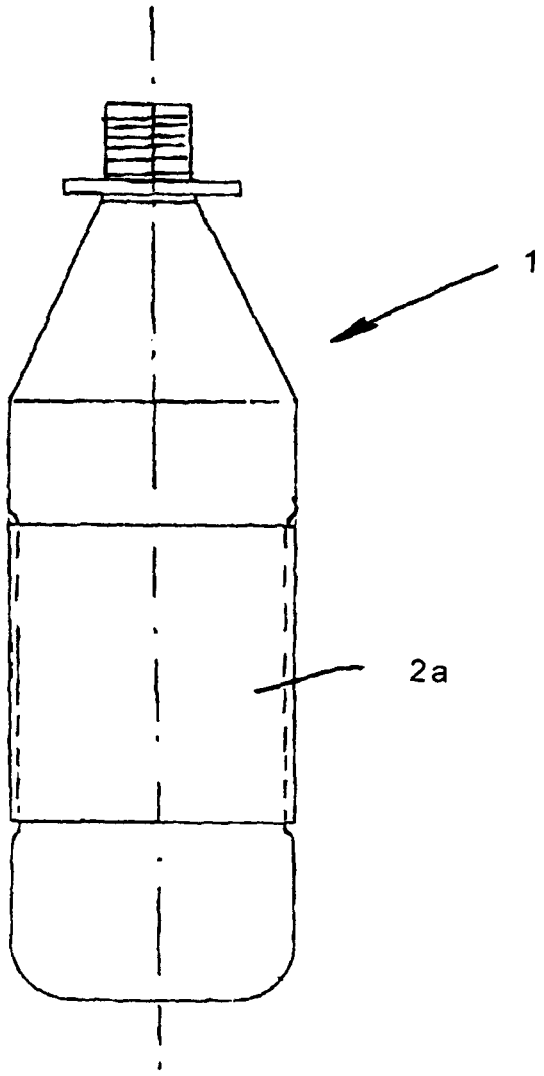
FIG. 1G shows a container in the form of a bottle which is to be printed.

FIG. 1G shows a bottle 1 which is to be provided with a printed image and/or printed information onto the indicated printing area 2*a*.

To achieve the essentially highest possible throughput and number of bottles printed per unit of time and an optimum print quality, at least one electrostatic print head 3 is used to print the bottles 1. This print head comprises a housing 4 which forms an enclosed housing interior 5 that holds a liquid or viscous ink. The housing 4 is realized so that its interior 5 tapers toward a lower housing segment 4.1 in the shape of a funnel or wedge. On this housing segment 4.1, which extends over the entire length of the housing 4 and is oriented parallel to a longitudinal axis DL of the housing or print head, there are a plurality of individually actuated individual nozzles 6 for the controlled discharge of the ink, and specifically arranged in at least one row, one behind another in the direction of the longitudinal axis DL of the print head and very close together, so that, for example, 150 or more individual nozzles, 6 or more per inch, can be formed on the housing segment 4.1.

With the housing segment 4.1 that has the individual nozzles 6, the nozzle head 3 is located at a small specified distance from the area of the respective bottle 1 to be printed, and specifically such that the longitudinal axis DL of the print head or the longitudinal dimension of the housing segment 4.1 is oriented parallel, or essentially or substantially parallel, to the surface line of the external surface of the bottle in the actual printing area, and in an area to be printed on a circular cylindrical external surface of the bottle 1, for example, parallel to the bottle axis FA.

In particular in the event that the external surface of the bottle is not circularly cylindrical to the bottles to be printed, at least one possible embodiment teaches that the at least one nozzle head 3 and the rotating bottle axis FA can be adjusted in relation to each other so that the individual nozzles 6 and the individual surface element to be printed of the external surface of the bottle are at an optimum or desired distance from each other.

Each individual nozzle comprises an opening 7 in the housing segment 4.1 and of a needle-shaped electrode 8 which is associated with this opening. The needle-shaped electrode 8 is oriented equi-axially with the respective opening 7 and ends at a short distance from this opening inside the housing interior 5. The print head 3 is oriented so that at least during the printing process, the ink that is contained in the housing interior 5 is applied with a certain hydrostatic pressure against the openings 7 of the individual nozzles 6. However, the cross section of the openings 7 is selected in consideration of the viscosity and/or of the surface tension of the ink, so that when an individual nozzle 6 is not activated, ink does not exit the individual opening 7 in spite of the hydrostatic pressure.

The electrodes 8 can be actuated individually by means of the control device 9, and specifically so that when an individual nozzle 6 is not actuated, the corresponding electrode 8 is at the same or similiar electrical potential as the ink in the housing interior 5. When an individual nozzle 6 is activated, the potential of the corresponding electrode 8 is modified briefly or in a pulsed manner by a corresponding actuation, so that ink to produce a dot 10 is applied to the bottle 1 via the opening 7.

The print head 3 is a component of a printer station 11 that has at least one such print head. For the calibration of the print head 3 with reference to the respective bottle 1 or its top or external surface, calibration and spacer elements are provided on the print head 3. Specifically, for example, the spacer elements are in the form of rollers 12 which are mounted so that they can rotate freely around an axle that is parallel or essentially parallel to the longitudinal axis DL of the print head. By means of the spacer elements, the print head 3 is supported on the bottle 1 outside the area to be printed.

Figure 2:
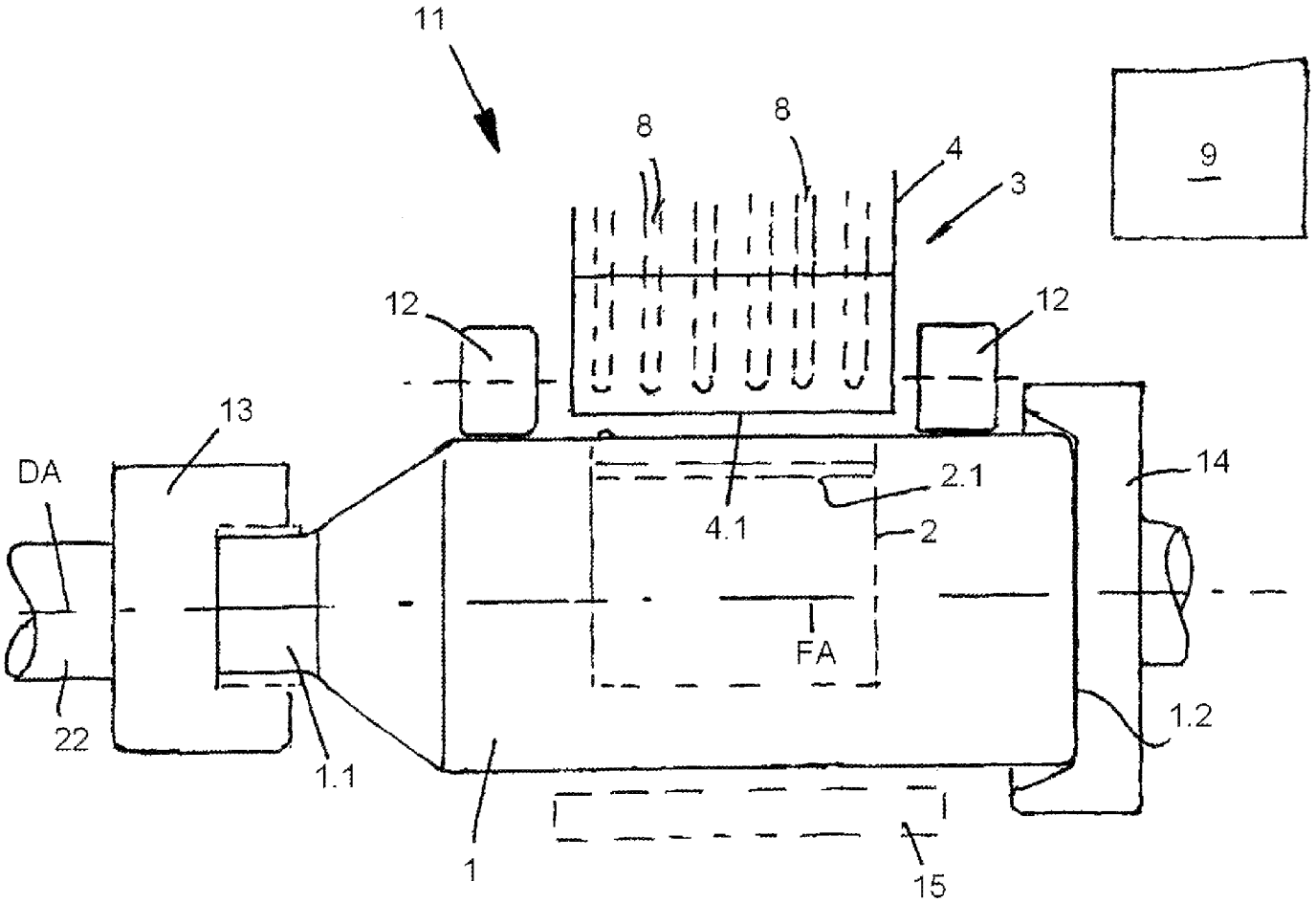

In the illustration selected for FIGS. 1 and 2, the bottle 1 to be printed is oriented with its bottle axis FA in the horizontal direction and is located underneath the nozzle head 3, i.e. the nozzle head 3 with its print head longitudinal axis DL is also oriented in the horizontal direction. During the printing process, the bottle 1 is rotated by a controlled drive around its bottle axis FA (Arrow A). The printing 2 is thereby applied in rows or lines 2.1, each of which extends parallel or essentially parallel to the bottle axis FA over the entire width of the area to be printed, and specifically progressively in the peripheral direction of the bottle 1. Because the individual nozzles 6 can be activated at high speed, and because only one individual relative motion between the respective bottle 1 and the print head 3 essentially is required for the printing, namely only the rotational motion of the bottle 1 around its bottle axis FA, a high printing throughput can be achieved. The individual printed image is generated purely digitally, and specifically without the need for a print mask, etc.

After the application of the ink on the bottle 1, the ink or the printed image is dried or hardened, for example by setting or drying in atmospheric air, by the application of a thermal and/or UV treatment, etc.

For the controlled rotation of the respective bottle 1 during the printing process, the bottle is held with its bottle mouth 1.1 on a clamping holder 13 which is driven around a printer station axis DA equi-axially with the bottle axis FA by a drive mechanism that is not shown in FIGS. 1 and 2 and actuated by the control device 9. By means of its bottom 1.2, the individual bottle 1 is in contact during the printing process against a support and centering element 14 that is realized in the form of a turntable.

Figure 2A:
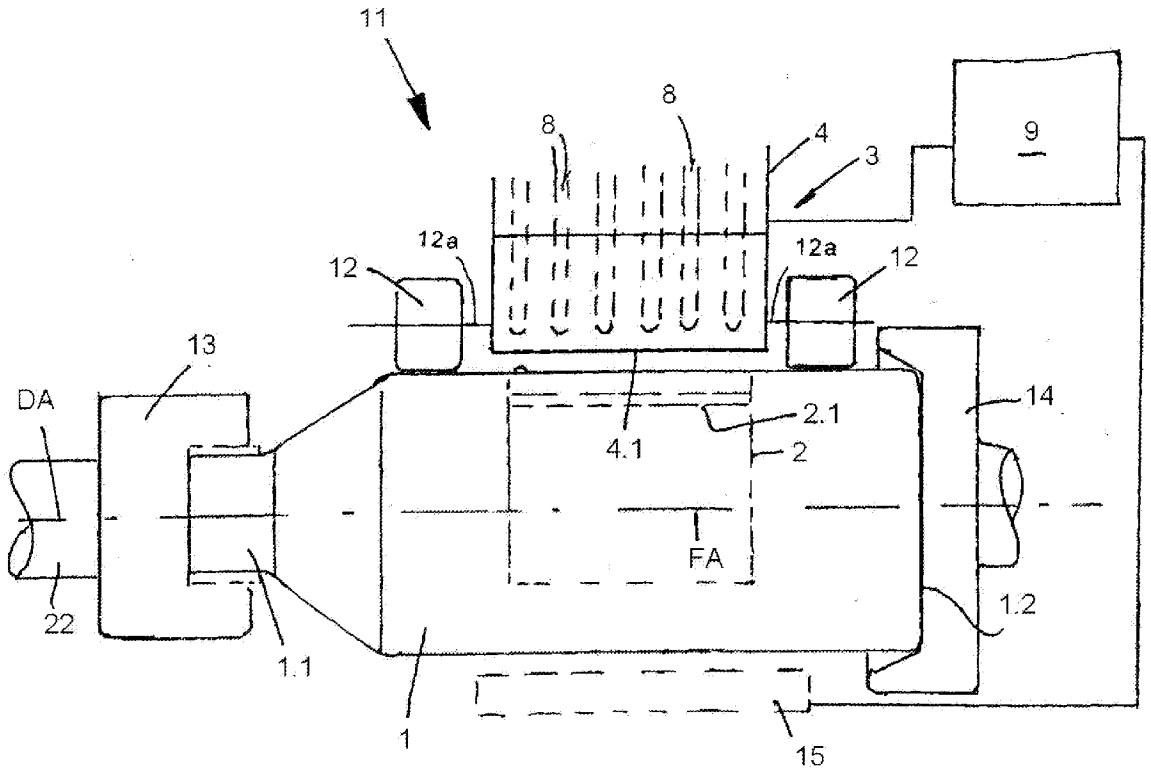
FIG. 2A shows an additional possible variation of the components shown in FIG. 2.

By means of the clamping holder 13 and the support element 14, the individual bottle 1 is thus properly positioned and centered in the printer station 11. By means of the rollers 12, the print head 13 is accurately positioned with reference to the external surface of the bottle 1 so that even if there are tolerances in the bottle diameter, the short distance between the print head 3 and the external surface of the bottle 1 necessary for an optimum printing is accurately maintained. In at least one embodiment, both of the rollers 12 are supported on a common axle 12*a*, as seen in FIG. 2A. In another possible embodiment, each of the rollers 12 is supported on separate axles 12*a*. The axle or axles 12*a* are directly or operatively connected to the print head 3 in order to connect the rollers 12 to the print head. In this manner, the rollers 12 and their axle or axles 12*a* can be utilized to position the print head 3 a desired distance from the surface of a bottle 1 to be printed, and also maintain the print head 3 at the desired distance during rotation of the bottle or container 1, regardless of the shape or size of the bottle 1.

To improve the printed impression 2 produced by the print head 3, in particular in terms of contrast and/or resolution, in the illustrated embodiment, on the printer station 11 a corona element 15 is provided with which the external surface of the bottle 1 is electrostatically charged at least in the area to be printed, and specifically with a polarity that is opposite to the electrical potential of the ink in the housing interior 5. Before the printing process, the area to be printed is moved past this corona element 15 which extends parallel or essentially parallel to the bottle axis FA or the printer station axis DA by rotation of the bottle 1. It is also possible to pressurize the bottle 1 before the printing process via the bottle mouth 1.1 with a deionized or electrically charged gaseous medium, for example with deionized or electrically charged air, to thereby achieve an electrostatic charging of the bottle 1 that improves the print quality.

In FIG. 2A, the orientation of the housing 4 and corona element 15 are directed by the electronic control device 9.

In the above explanation it was assumed that the printed impression 2 is created with only one single ink and the printer station 11 accordingly has only one single print head 3. As a rule, however, multi-color printing is often necessary, and specifically using at least three different inks (e.g. red, blue and yellow), as well as an optional additional black ink. For this purpose, the printer station is realized with a plurality of print heads 3, i.e. with at least three print heads 3 as illustrated schematically in FIG. 3. The individual print heads 3 are provided offset by an angle from one another, for example, around the bottle axis FA or around the axis of the printer station DA, and specifically so that the axes of the openings 7 and electrodes 8 of all the print heads are each oriented radially or essentially radially with respect to the printer station axis DA or the bottle axis FA and thus perpendicular or essentially perpendicular to the respective area of the surface of the bottle 1 that is currently being printed. The printing process is then carried out so that in a plurality of sequential work steps, each of which takes place while the bottle 1 rotates around the bottle axis FA and using a print head 3, the ink that corresponds to an ink set of the multiple-color printing is applied and then, after drying or hardening, the additional ink set is applied using an additional print head 3.

As a result of the offset arrangement of the print heads 3 on the printer station 11*a*, it is essentially necessary for only one of the print heads 3 to have optimal positioning with reference to the bottle 1 to be printed, i.e. a positioning in which the longitudinal axis of the print head lies in a vertical printing plane that encloses the bottle axis FA. To achieve essentially optimal or desired conditions for all the print heads 3 of the printer station 11*a*, it may be advantageous, in at least one possible embodiment, to realize the printer station 11*a* so that each print head 3, before the printing process, is positioned with the axis of its individual nozzles 6 in the printing plane DE, and specifically, for example, so that the print heads 3 are provided on a common carrier that can be pivoted around the bottle axis FA or the printer station axis DA, as indicated with the double arrow B in FIG. 3. Other measures are also conceivable.

Figure 3:
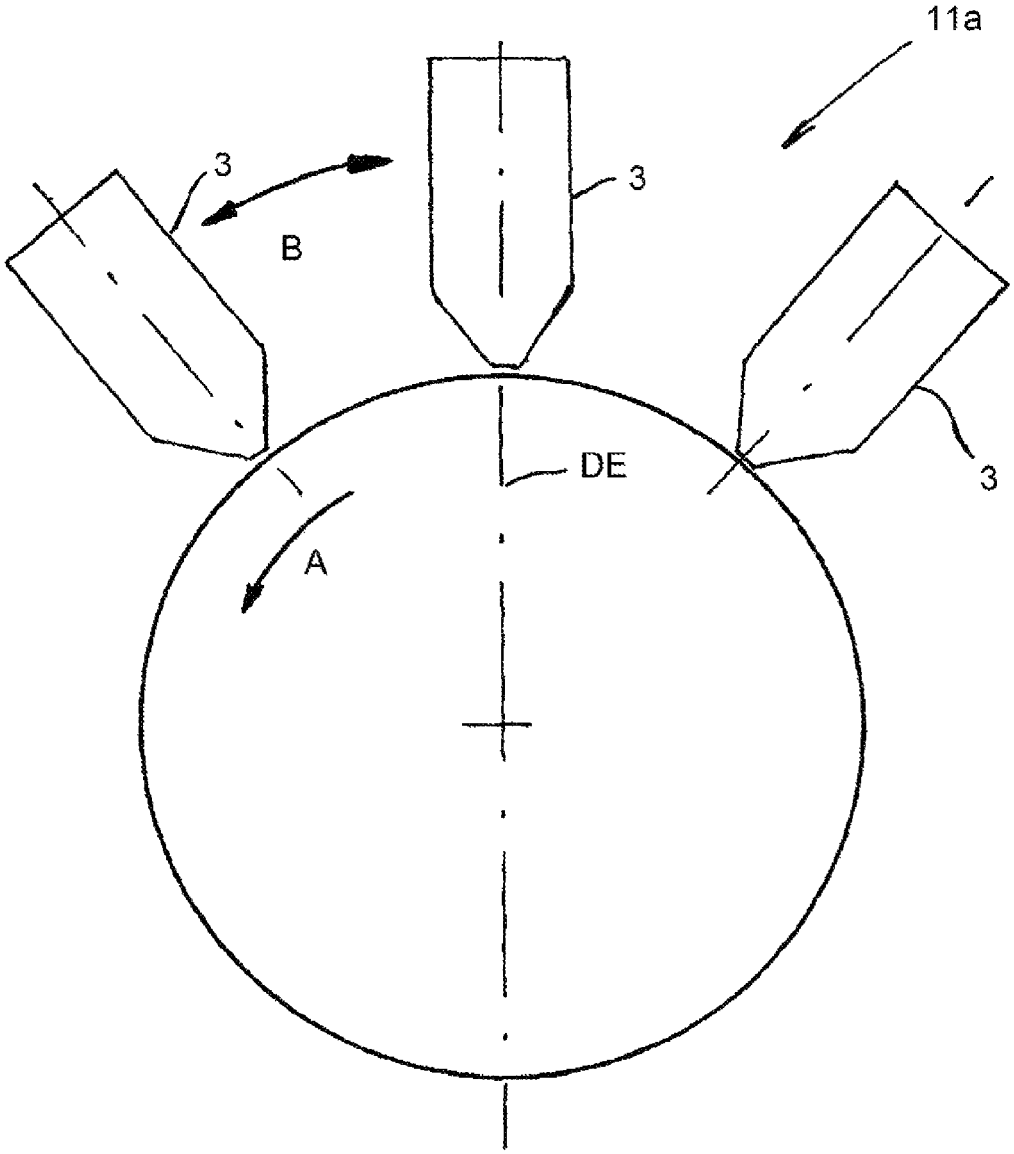
FIG. 3 is a schematic illustration of a printer station with three print heads for the production of a multi-color printed image on a container.
Figure 3A:
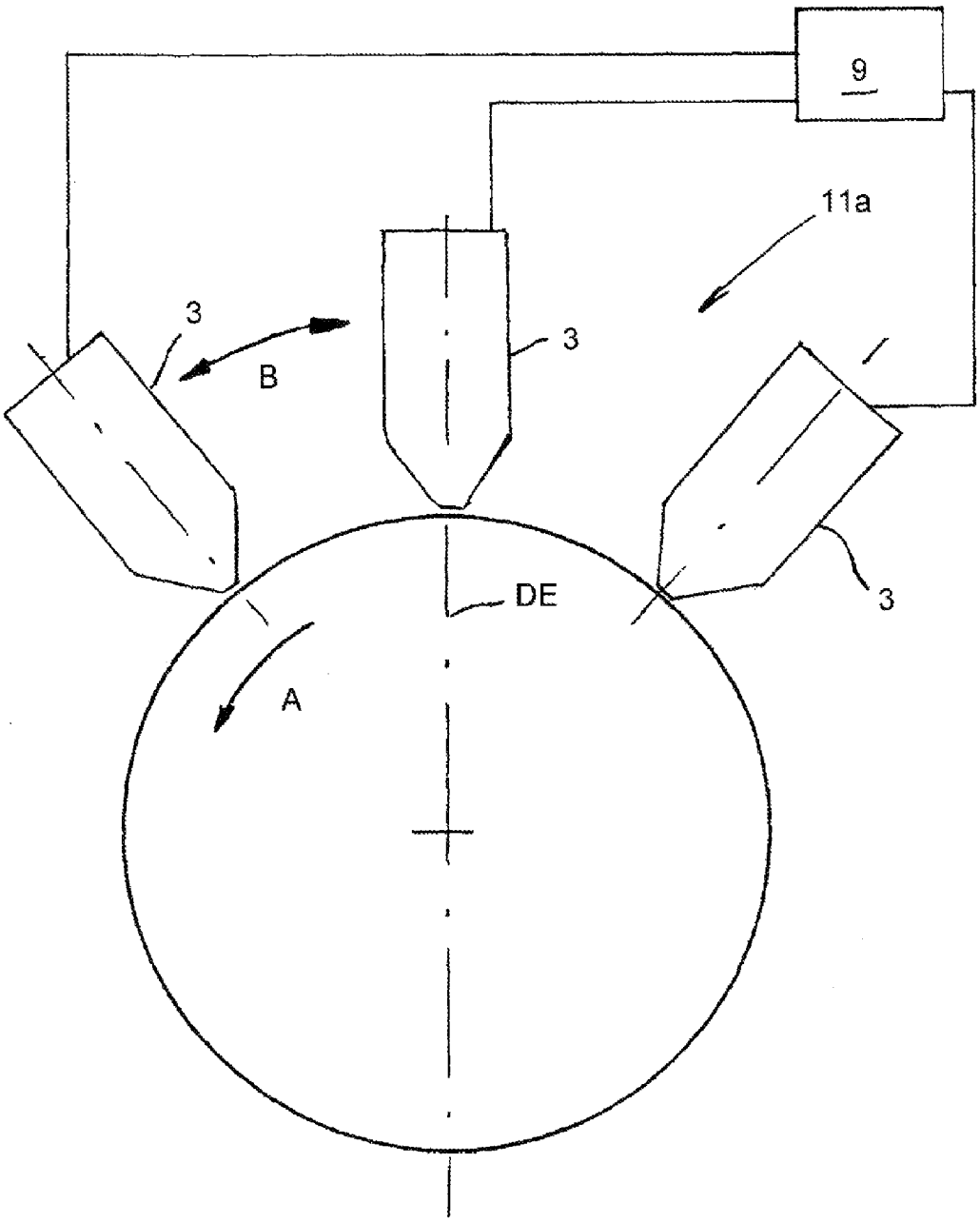
FIG. 3A shows an additional possible variation of the components shown in FIG. 3.

In FIG. 3A, the orientation of the print heads 3 are directed by the electronic control device 9.

For the centering of the print heads 3 with reference to the respective bottle 1, centering means, e.g. in the form of rollers 12, are in turn provided on the printer station 11*a*. The respective bottle 1 is also held and centered in the printer station 11*a* by the clamping holder 13 and the support element 14. To increase the quality of the multiple-color impression 2, the printer station 11*a* also has, for example, the corona element 15 and/or means to pressurize the respective bottle 1 on the inside with the electrically charged or deionized gaseous medium.

The motor drive for the clamping holder 13 may further be realized so that at the beginning of each printing process, and in particular at the beginning of the printing of each ink set of the multi-color printing, the clamping holder 13 is in a clearly defined position, for example by a means of a regulation process that includes feedback of the current position of the clamping holder 13 to the control device 9 and by comparing the current position and measurement with a specified setpoint.

Figure 4:
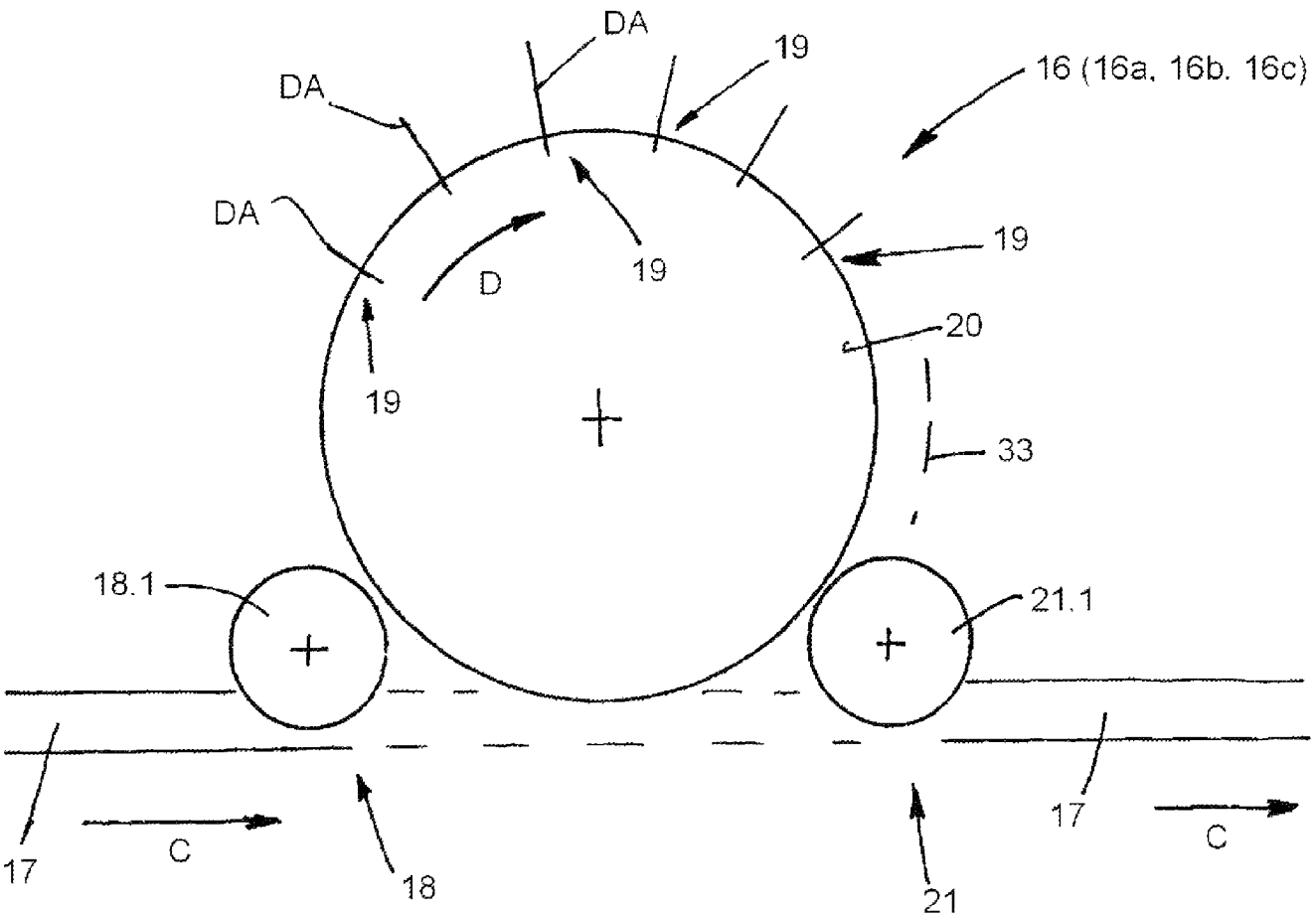
FIG. 4 is a schematic illustration in an overhead view of a machine with a rotary construction that can be used to print containers.

FIG. 4 is a schematic illustration in an overhead view of a machine 16 of the rotary construction for printing bottles 1. The bottles 1 standing in the upright position are fed to the machine 16 via a conveyor belt 17 in the form of a single-line stream of bottles, indicated by arrow C, and arrive at a bottle inlet 18, among other things via an inlet star wheel 18.1, arrive individually at a printer station 19 at a rotor 20 that is driven so that it rotates around a vertical machine axis MA in the direction indicated by the arrow D. The printer stations 19, which are each indicated in FIG. 4 only by their printer station axis DA, are realized for example so that they correspond to the printer station 11*a* and are provided at uniform angular intervals around the periphery of the rotor 20. With the rotational motion of the rotor 20, the printed bottles 1 reach the bottle outlet 21 where they are transported further, by means of an outlet star wheel 21.1 located there, to the conveyor 17 and are then fed in the upright position on this conveyor to an additional application.

Figure 5:
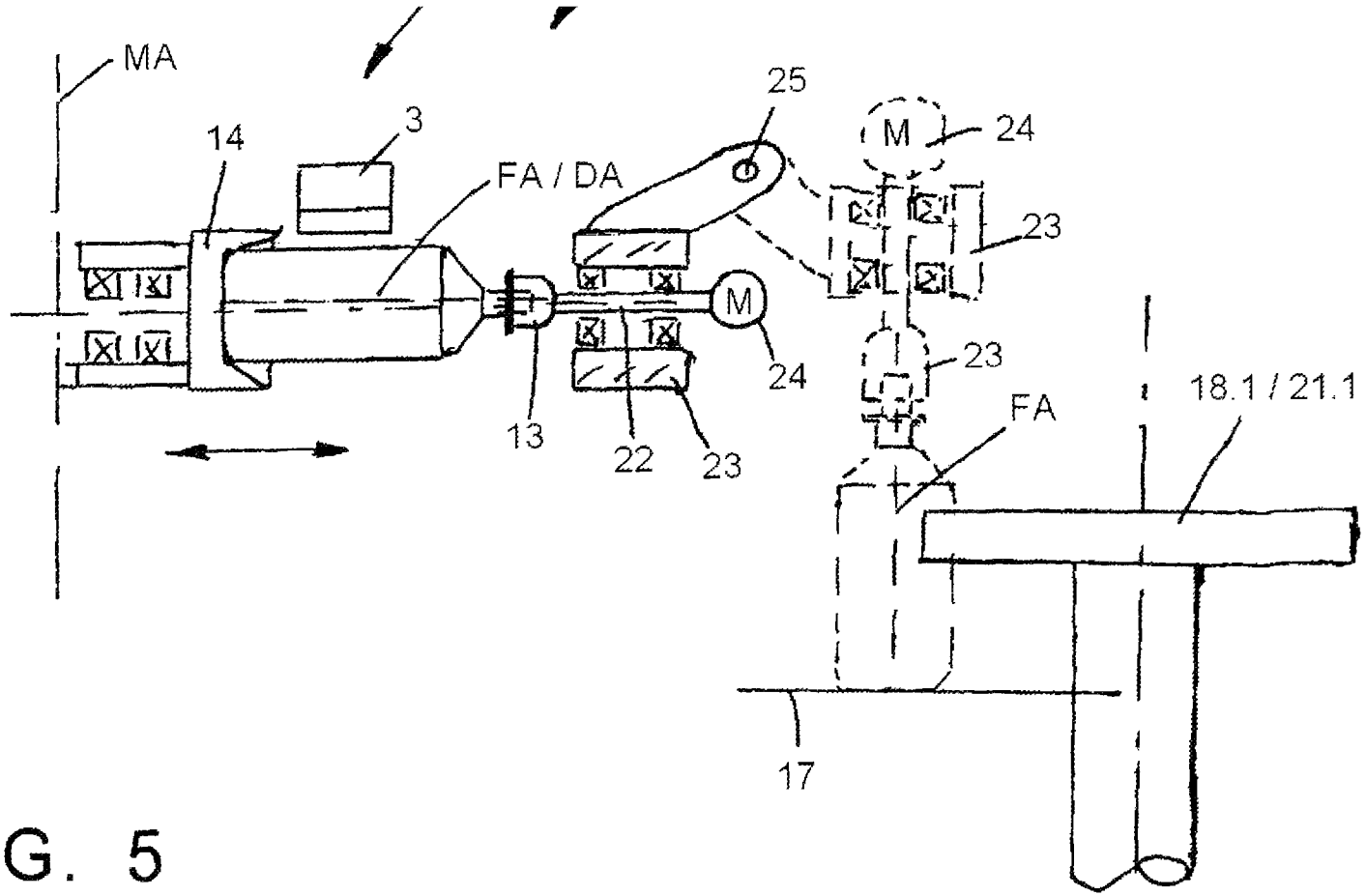
FIG. 5 shows the printer stations of the machine illustrated in FIG. 4 during the printing of a container.

FIG. 5 shows a printer station 19 in greater detail. Each printer station 19 is provided, like the printer station 11*a*, with a plurality of print heads 3, only one of which is shown in FIG. 5, with the clamping holder 13 and with the support element 14. The additional elements that are described in connection with the printer station 11 or 11*a* are also present on each printer station 19, for example.

The clamping holder 13 of each printer station 19 is provided on a shaft 22 which is mounted in a pivoting bearing support bracket 23, on which the motor drive 24 for the shaft 22 and clamping holder 13 is also provided. The bearing support bracket 23 is provided at 25 on the rotor 20 so that it can pivot around a horizontal axis tangential to the direction of rotation D of the rotor 20, and in one possible embodiment under the control of a control cam (not shown), such that with the clamping holder 13 on the bottle inlet 18 the individual bottle 1 is picked up and moved by pivoting of the bearing support bracket 12 around the axle 25 into a horizontal position oriented or essentially radially with respect to the machine axis MA. The bottle 1 in question is then clamped between the clamping holder 13 and the support element 14 and the support element 14 underneath the print heads 3, and specifically such that the respective bottle 1 is oriented with its bottom 1.2 in the direction of the machine axis MA. In this embodiment, the print heads 3, the support element 14 and the additional function elements of the individual printer stations 19 are stationary, i.e. they do not pivot with the clamping holder 13 on the rotor 20. The print heads 3 in this embodiment are also oriented, at least during the printing process, with their longitudinal axis L radial or approximately radial with respect to the machine axis MA.

Figure 5A:
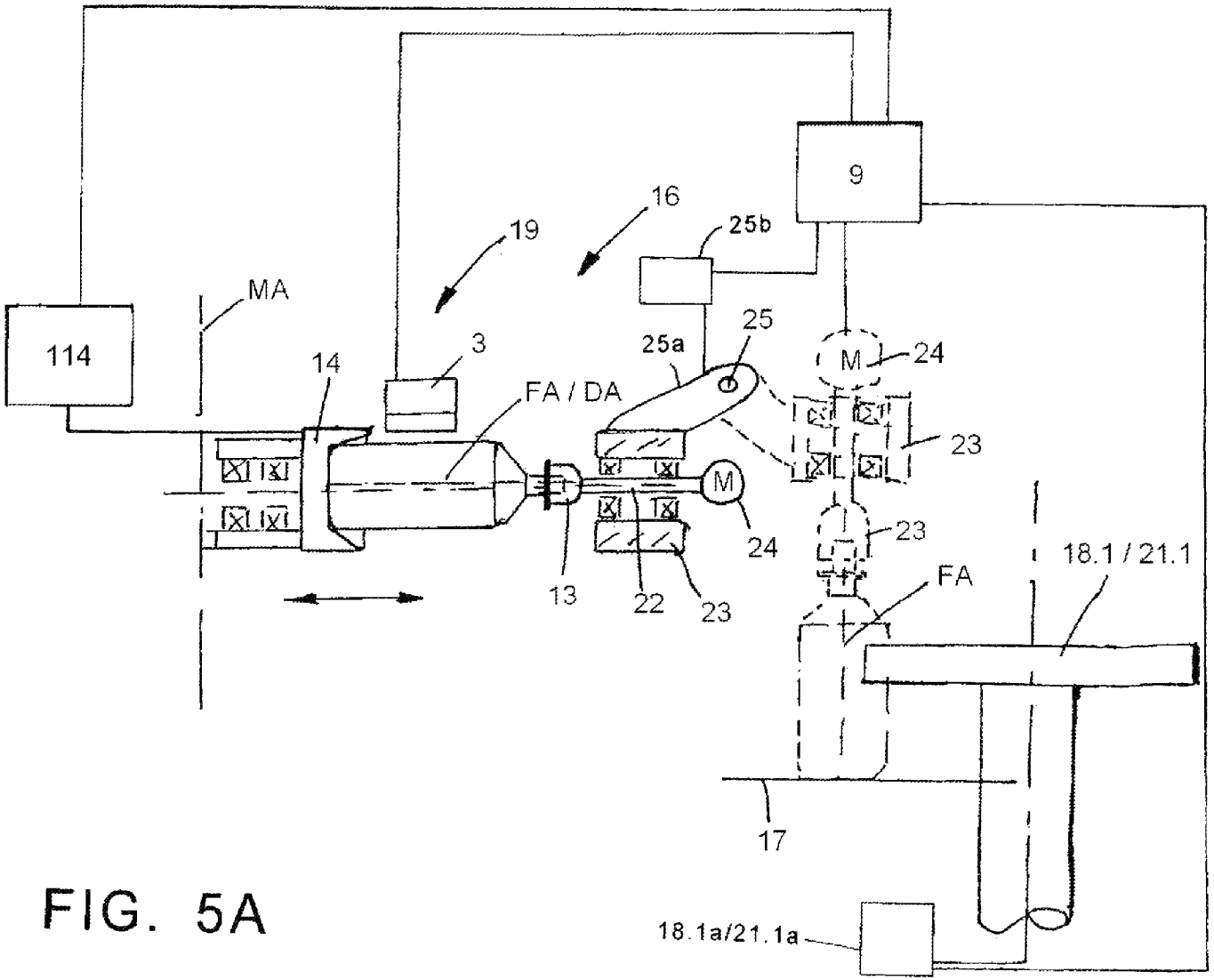
FIG. 5A shows an additional possible variation of the components shown in FIG. 5.

As seen in FIG. 5A, in at least one possible embodiment, the support element 14 may be moved to a desired position by means of an acutator device 114, which is directed by the electronic control device 9. In this manner, the bottle 1 is moved to an appropriate position for printing. It is also shown, that in at least one possible embodiment, the print head 3 is directed or controlled by means of the electronic control device 9. The electronic control device 9 also directs the motor drive 24 as a means to orient the bottle 1 as desired. In another possible embodiment, an inlet star wheel actuator 18.1*a* and an outlet star wheel actuator 21.1*a* are directed by the electronic control device 9. It is also shown in FIG. 5*a* that in at least one possible embodiment, an axle actuator 25*b* is directed by the electronic control device 9 to move an axle arm 25*a* as a means of moving the bottle 1 into an essentially horizontal position.

Figure 6:
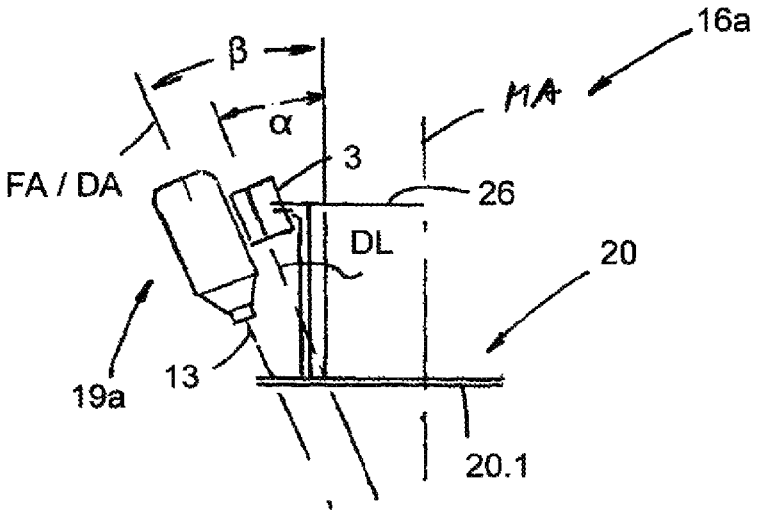
FIGS. 6-9 are each simplified functional illustrations of one of the printer stations of a machine with a rotary construction, and specifically on other embodiments of the present application.

FIG. 6 is a very schematic illustration of a machine 16*a* which differs from the machine 16 essentially in that the print heads 3, at least during the printing process, are oriented with their print head longitudinal axis DL horizontal and radial with respect to the machine axis MA, but enclose with the machine axis MA or an axis that is parallel to it an angle α that opens toward the top of the machine. Each print head 3 is therefore inclined radially outward and at least during the printing process lies with its print head longitudinal axis DL in a common plane with the machine axis MA, and specifically such that the housing area 4.1 that contains the individual nozzles lies radially outward with reference to the machine axis MA and thus the distance of the individual nozzles 6 from the machine axis MA increases from the lower end of the individual nozzle head 3 to the upper end. As a result of this inclination of the respective nozzle head 3, at least during the printing process the pressure of the ink at the individual ink jets 6 or at the openings 7 of the nozzle head 3, which pressure results from gravity and the centrifugal force when the rotor 20 is in rotation, is constant or approximately constant, or pressure differences that result from the gravity acting on the ink and from centrifugal force, offset each other so that during the activation or actuation of the individual jets, the same application of ink or dots 10 is always achieved.

Depending on the inclination of the print heads 3, the bottles 1 are also inclined at least during the printing process, i.e. the surface line of the external surface of the bottle at the line 2.1 currently being printed encloses the angle β with the machine axis MA or the axis parallel to it. When the area to be printed is in the shape of a circular cylinder, the angles α and β are equal or essentially equal. Therefore each bottle 1 is oriented during the printing process with its bottle axis FA parallel or essentially parallel to the printing longitudinal axis DL. In the illustrated embodiment, the individual printer stations 19*a*, which in turn have all the elements of the printer station 19 or 11*a*, are realized so that the bottles 1 are held during the printing process with the bottle bottom 1.2 up and with the bottle mouth 1.1 down.

Figure 7:
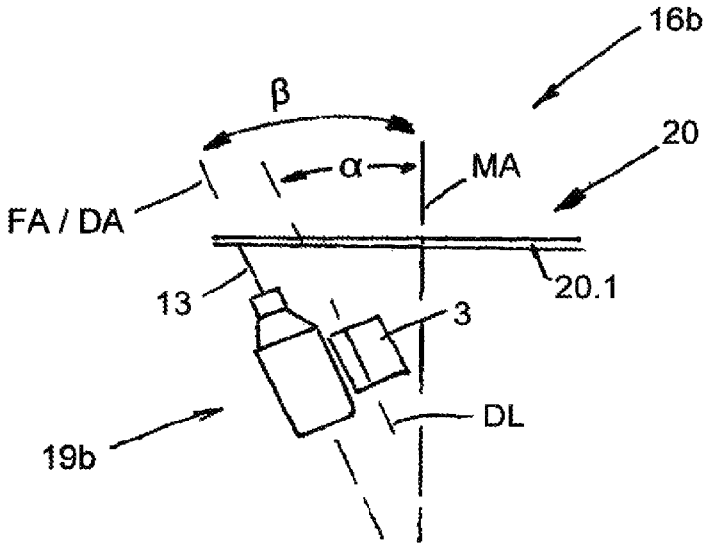

FIG. 7 shows, as one additional possible embodiment, a machine 16*b* which differs essentially from the machine 16*a* only in that the bottles 1 point upward during the printing process with their bottle mouth 1.1 held in the clamping holder 13, and are thus inclined radially inward and are located underneath the rotor element 20.1, and do not, as on the machine 16*a*, project radially above the rotor element 20.1 during the printing.

Figure 8:
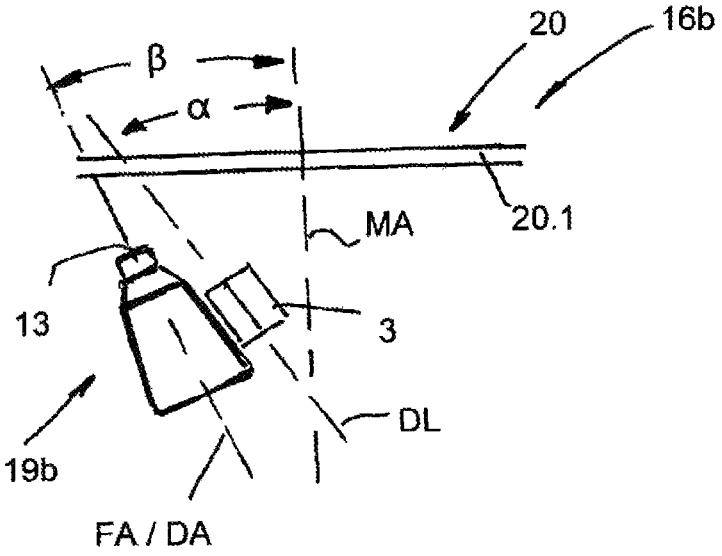

FIG. 8 once again shows the machine 16*b*, but in its realization for printing bottles 1*a* on a conical peripheral surface. The print heads 3 again have the inclination with respect to the machine axis M. The inclination β of the bottle axes FA with respect to the machine axis MA is thereby significantly different from the inclination α.

One feature common to the machines 16*a* and 16*b* is that the respective print head 3, at least during the printing process, is located between the respective bottle 1 and the machine axis MA, thus the individual bottle 1 is offset radially outward with respect to the machine axis MA toward the print head 3.

On the machines 16*a* and 16*b*, the array of print heads that has the print heads 3 is realized so that the individual print head 3 being used can be moved into the optimal printing position, for example by the pivoting indicated by the double arrow B in FIG. 3, and so that each print head 3 on the print head holder 26 and/or each print head holder 26 can be pivoted on the rotor 20 or on the rotor element 20.1 around an axis perpendicular to the print head longitudinal axis DL, and can in particular be adjusted in the print head longitudinal axis DL to be able to adjust the respective printer station 19*a* or 19*b* to the shape of the bottles 1 or 1*a* to be printed and/or the angle of inclination α corresponding to the speed of rotation of the rotor 20 can be set to achieve the most uniform possible or desirable distribution of the ink along the individual nozzles 6 during the printing process.

Figure 9:
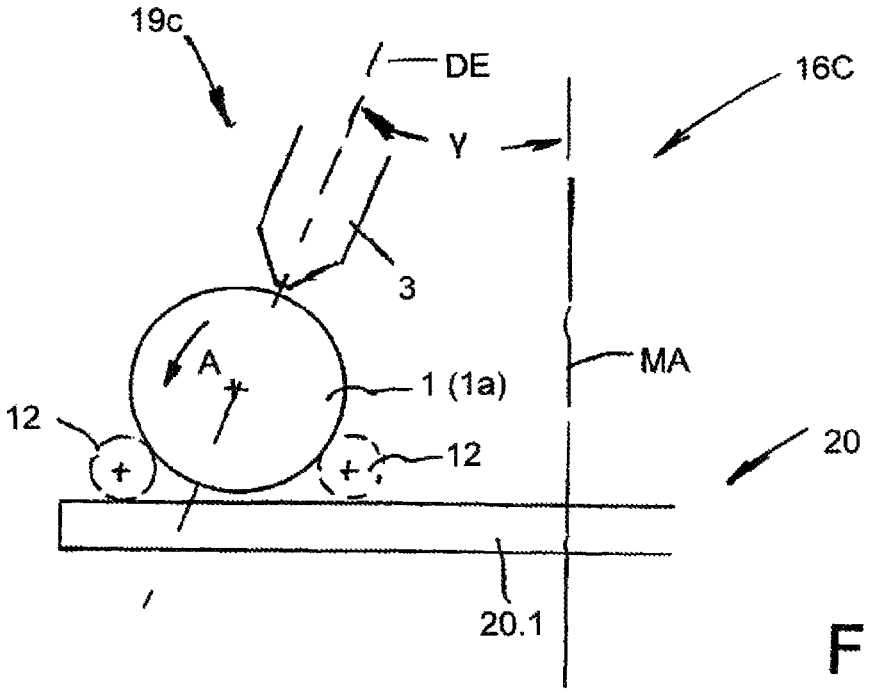

FIG. 9 shows as an additional embodiment a machine 16 which differs from the machines 16 and 16*b* essentially in that the print heads 3, at least during the printing process, are oriented with their print head longitudinal axis DL tangential or approximately tangential to the direction of rotation D of the rotor 20 or of the rotor element 20.1. To improve the printing, it may be appropriate to also orient the print heads 3 during the printing process so that the axes of the individual nozzles 6 are slightly inclined with respect to the vertical or machine axis MA, i.e. they enclose an acute angle γ with the vertical, which opens toward the bottom of the machine 16*c*. During the printing process, the bottles 1 are located underneath the respective nozzle head 3, and specifically so that the surface line on which the current line 2.1 is printed is oriented parallel or essentially parallel to the print head longitudinal axis DL and thus also tangential or approximately tangential to the rotational movement D of the rotor 20.

In the above description, it was assumed that the print heads 3, at least during the printing process, are inclined with their print head longitudinal axes DL oriented radially with respect to the machine axis MA or with respect to the machine axis MA, but lie in a common vertical plane with this machine axis and/or tangential to the rotational movement of the rotor. Other orientations of the print head longitudinal axes DL are conceivable, for example so that the individual print head longitudinal axis DL is inclined toward or opposite the direction of rotation D of the rotor 20, and specifically instead of or in addition to the inclination radially outward or radially inward.

Figure 10:
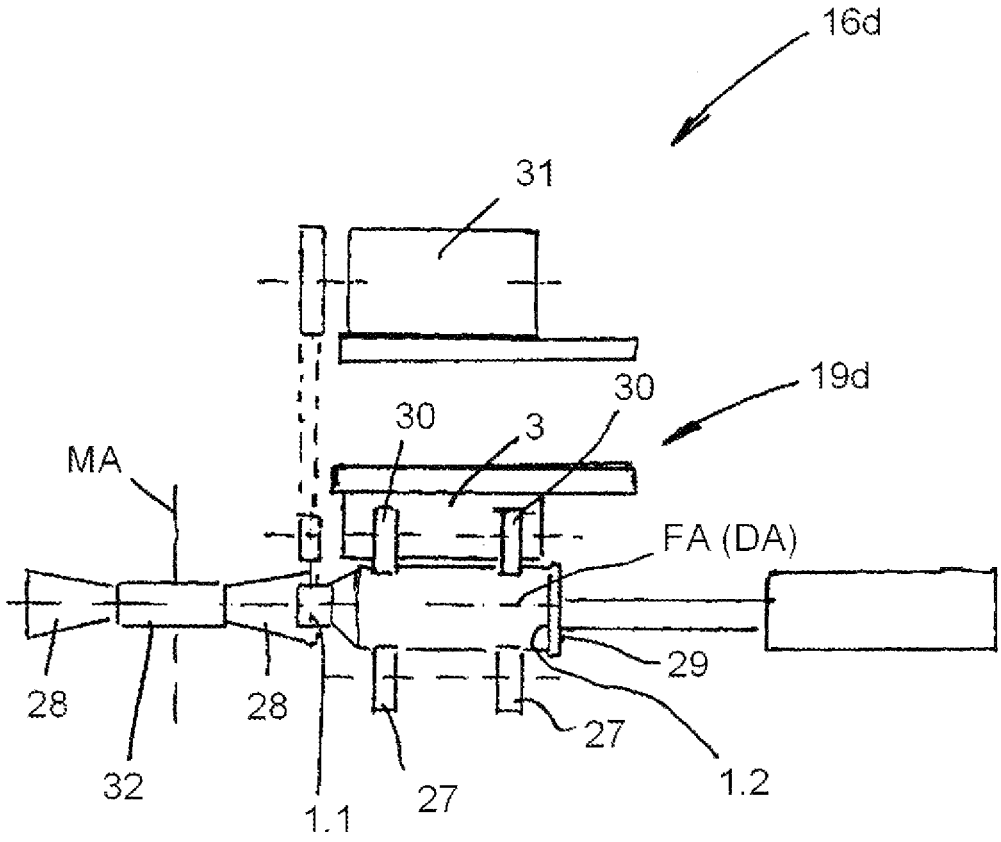
FIG. 10 shows an additional embodiment of the device describe in the present application in the form of a clocked machine.

FIG. 10 shows, in the form of an additional embodiment of a machine 16*d* which is not realized in the form of a rotary machine but in the form of a linear machine, for example in the form of a clocked machine. With this machine, the bottles 1 to be printed are each fed individually to the printer station 19*d*, where they are centered by the bottom rollers 27 located there. For the printing process, each bottle 1 with its bottle axis FA oriented horizontally is clamped between a clamping holder 28 on the bottle mouth 1.1 and a support element 29 that corresponds to the support element 14. Above the respective bottle is the print head array that has at least one print head 3, which is supported on the bottle mouth by means of top rollers. The top rollers 30 are driven by a drive motor 31 around a common axis that is parallel or essentially parallel to the bottle axis FA, and specifically for the rotational movement of the bottle 1 during the printing process. The clamping holder 28 is provided together with a plurality of clamping holders 28 on a rotor 32 that can be driven in rotation around a machine axis MA, which rotor, after the printing of a bottle 1, continues to turn by one rotation step or one interval to remove the printed bottle 1 from the printer station 19*d*, which does not move with the rotor 32, and to introduce a new bottle 1 to be printed into the printer station.

One thing that the machines 16*a*, 16*b*, 16*c* and 16*d* have in common, for example, is that on each printer station 19-19*d*, means are also provided that make it possible to orient the respective impression 2 to design features that are present on the bottles 1 or 1*a*. For example, using an image recognition system, each bottle 1 or 1*a* can be oriented before being printed by rotation around its bottle axis FA, so that it has a specified orientation with reference to the design feature at the beginning of the printing process.

In at least one possible embodiment, an apparatus or method for realizing an accelerated drying or hardening of the ink may be incorporated in a step following the printing of the bottles 1. In particular on the machines 16, 16*a*, 16*b*, 16*c* and/or 16*d*, there is also the capability, in an angular range of the rotational movement of the rotor 20 or 32, which angular range after the printing or the bottles 1 or 1*a* follows the printer station, of providing means to achieve an accelerated drying or hardening of the ink, for example by the action of heat and/or UV radiation. On the machines 16, 16*b*, 16*c*, it is possible for this purpose to move the bottles 1 or 1*a* that are being held in the clamping device 13 with the rotating rotor into a channel that extends over a partial angle of the rotational movement of the rotor 20 and to move the bottles along this channel.

The present application was described above on the basis of exemplary embodiments. It goes without saying that numerous modifications and variations can be made without thereby going beyond the teaching of the present application.

For example, instead of the rollers 12 that act as spacers, it is possible to set the distance between the external surface of the bottle to be printed and the print head 3 so that this distance is set by a sensor that is provided on the print head 3, for example so that it is monitored by an ultrasound or light sensor and set by means of a motor drive.

With regard to the labeling of containers, there are existing methods in which, in a first step, the containers are provided with a label or are printed by means of the conventional printing processes, whereby both the label as well as the printed information are necessarily identical or constant on all containers. These are methods in which the containers are provided with variable information in a second step, whereby this information can differ from container to container, such as differing serial numbers; from container group to container group, such as differing batch numbers; or even from day to day production dates.

The device described above is characterized by, among other things, the fact that the printed image to be applied to the container or the container labeling is stored in digital form inside the electronic control unit 9, and is then applied to the container without the use of labels or print masks.

Because the printed image to be applied is stored in digital form, it becomes possible for the first time to redesign or reconfigure this printed image for each container to be labeled, and thus, for example, to recompose it for each container from constant and variable content or information.

At least one possible embodiment also teaches that the variable information can also be graphic information. On account of this method, it becomes possible, for example, to label beverage packages in any desired sequence and quantitative distribution with graphic representations of the players on favorite sports teams, such as football, for example.

It is possible that at least one embodiment of the present application may include a printing device for the application of ink, resin-based pigments, paint, enamel, and/or paint-like or enamel-like substances to the external surface of a container.

At least one possible embodiment also teaches that the variable information can be numerical and/or alphanumerical information, for example a production date or a "best if consumed by" date or a numerical code.

On a device for the imprinting of bottles or similar containers on a container surface, in particular one that is cylindrical or conical and is rotationally symmetrical around a container axis, with at least one print head 3, the print head used is an electrostatic print head with a plurality of individually actuated individual nozzles for the controlled dispensing of ink.

At least one possible embodiment of the present application relates to beverage bottling plant for filling beverage bottles with a liquid beverage, with an information adding arrangement for adding information relating to the beverage bottles. This application also relates to a method of operating a beverage bottling plant for filling beverage bottles with a liquid beverage, with an information adding arrangement for adding information to the beverage bottles. This application further relates to a device for the application of information and/or images onto the external surface of containers. One possible embodiment of the present application may be realized in a device for imprinting bottles or similar containers on their container external surfaces, with at least one printer station having at least one print head, characterized in that the at least one print head is an electrostatic print head with a plurality of individually actuatable individual nozzles for the controlled dispensing of ink, and that the individual nozzles are located in a row one after another in a print head longitudinal axis.

One feature or aspect of an embodiment is believed at the time of the filing of this patent application to possibly reside broadly in a device for imprinting bottles 1, 1*a* or similar containers on their container external surfaces, with at least one printer station 11, 11*z*, 19, 19*a*, 19*b*, 19*c*, 19*d* having at least one print head 3, characterized in that the at least one print head is an electrostatic print head 3 with a plurality of individually actuatable individual nozzles 6 for the controlled dispensing of ink, and that the individual nozzles 6 are located in a row one after another in a print head longitudinal axis DL.

Another feature or aspect of an embodiment is believed at the time of the filing of this patent application to possibly reside broadly in the device, characterized in that the containers 1, 1*a* are oriented, at least during the printing process, with their container axis FA equi-axial or essentially equi-axial with a printer station axis DA.

Yet another feature or aspect of an embodiment is believed at the time of the filing of this patent application to possibly reside broadly in the device, characterized by means 13, 24, 30, 31 for the generation of a controlled relative movement between the container 1 to be imprinted and the at least one print head 3 around the container axis FA or printer station axis DA during the printing process.

Still another feature or aspect of an embodiment is believed at the time of the filing of this patent application to possibly reside broadly in the device, characterized in that the container 1 is rotated around its container axis FA by the means for the generation of the relative movement.

A further feature or aspect of an embodiment is believed at the time of the filing of this patent application to possibly reside broadly in the device, characterized in that the container 1 is moved by the means for the generation of the relative movement of the at least one print head around the container axis FA.

Another feature or aspect of an embodiment is believed at the time of the filing of this patent application to possibly reside broadly in the device, characterized in that the individual nozzles 6 define a printing area 4.1 and that the length of this printing area 4.1 is equal to or greater than the width of a printed image produced during the imprinting that extends in the direction of the container axis FA.

Yet another feature or aspect of an embodiment is believed at the time of the filing of this patent application to possibly reside broadly in the device, characterized by a preferably computer-assisted control device 9 for the actuation of the individual nozzles 6 of the at least one print head 3 and for the actuation of the means for the generation of the relative movement between the individual container 1, 1*a* and the at least one print head 3.

Still another feature or aspect of an embodiment is believed at the time of the filing of this patent application to possibly reside broadly in the device, characterized in that the at least one printer station 11*a*, 19, 19*a*, 19*b*, 19*c*, and/or 19*d* has at least two and preferably at least three print heads 3.

A further feature or aspect of an embodiment is believed at the time of the filing of this patent application to possibly reside broadly in the device, characterized in that a plurality of print heads 3, each of which is associated with an area 2 to be imprinted, are provided for the generation of a multiple-color image.

Another feature or aspect of an embodiment is believed at the time of the filing of this patent application to possibly reside broadly in the device, characterized in that the print heads 3 are provided offset from one another around the container axis or around the printer station axis DA.

Yet another feature or aspect of an embodiment is believed at the time of the filing of this patent application to possibly reside broadly in the device, characterized in that the print heads 3 can each be moved for printing into a printing position or into a printing plane DE that defines this printing position.

Still another feature or aspect of an embodiment is believed at the time of the filing of this patent application to possibly reside broadly in the device, characterized in that the printer station axis DA is a horizontal axis, at least during the printing process.

A further feature or aspect of an embodiment is believed at the time of the filing of this patent application to possibly reside broadly in the device, characterized in that the printer station axis DA encloses an angle with the horizontal, at least during the printing process.

Another feature or aspect of an embodiment is believed at the time of the filing of this patent application to possibly reside broadly in the device, characterized in that on conical surfaces to be imprinted, the print head longitudinal axis DL, at least during the printing process, encloses an angle with the container axis FA or with the printer station axis DA that is equal or approximately equal to one-half of the conical angle of the conical surface of the container.

Yet another feature or aspect of an embodiment is believed at the time of the filing of this patent application to possibly reside broadly in the device, characterized in that the at least one print head 3 of the at least one printer station 11, 11*a*, 19, 19*c*, and/or 19*d*, at least during the printing process, is oriented with its printing area 4.1 that has the individual nozzles 6 above the container surface to be printed.

Still another feature or aspect of an embodiment is believed at the time of the filing of this patent application to possibly reside broadly in the device, characterized in that the at least one printer station 11, 11*a*, 19, 19*a*, 19*b*, 19*c*, and/or 19*d* has means 13, 28 to grip and/or fix the individual container 1, 1*a* in the printing position.

A further feature or aspect of an embodiment is believed at the time of the filing of this patent application to possibly reside broadly in the device, characterized in that the means to grip and/or fix the container 1, 1*a* are formed by at least one clamping holder 13, 28 and at least one support and/or centering element 14, 29, between which the individual container 1, 1*a* is held or chucked at least during the printing process.

Another feature or aspect of an embodiment is believed at the time of the filing of this patent application to possibly reside broadly in the device, characterized in that when the containers are realized in the form of bottles 1, 1*a*, the means to grip and/or fix the bottles 1, 1*a* are realized so that their hold the bottles 1, 1*a* in the vicinity of their bottle opening 1.1 or of their bottle neck.

Yet another feature or aspect of an embodiment is believed at the time of the filing of this patent application to possibly reside broadly in the device, characterized in that the at least one print head 3 of at least one printer station 11, 11*a*, 19, 19*a*, 19*b*, 19*c*, 19*d* can be adjusted for the printing on the container surface.

Still another feature or aspect of an embodiment is believed at the time of the filing of this patent application to possibly reside broadly in the device, characterized in that the at least one print head 3 of the at least one printer station 11, 11*a*, 19, 19*a*, 19*b*, 19*c*, 19*d* is held at some distance from the container surface by at least one spacer element 12.

A further feature or aspect of an embodiment is believed at the time of the filing of this patent application to possibly reside broadly in the device, characterized by a spacing measurement system for the setting and/or regulation during the printing process of the distance between the at least one print head 3 and the container surface to be printed.

Another feature or aspect of an embodiment is believed at the time of the filing of this patent application to possibly reside broadly in the device, characterized by means 33 for drying or hardening of the ink applied to the surface of the container, for example by the action of heat and/or UV radiation.

Yet another feature or aspect of an embodiment is believed at the time of the filing of this patent application to possibly reside broadly in the device, characterized by its realization in the form of a rotary machine with a plurality of printer stations 19, 19*a*, 19*b*, 19*c* on a rotor that is driven in rotation around a machine axis MA.

Still another feature or aspect of an embodiment is believed at the time of the filing of this patent application to possibly reside broadly in the device, characterized in that the printer station axis DA of each printer station 19 is oriented radially or approximately radially with respect to the machine axis MA at least during the printing process.

A further feature or aspect of an embodiment is believed at the time of the filing of this patent application to possibly reside broadly in the device, characterized in that the printer station axis DA of each printer station 19*a*, 19*b*, at least during the printing process, is inclined with respect to the machine axis MA and/or with respect to the axis of rotation of the rotor 20.

Another feature or aspect of an embodiment is believed at the time of the filing of this patent application to possibly reside broadly in the device, characterized in that the printer station axis DA of each printer station 19*c*, at least during the printing process, is oriented so that it is tangential or approximately tangential to the direction of rotation D of the rotor 20.

Yet another feature or aspect of an embodiment is believed at the time of the filing of this patent application to possibly reside broadly in the device, characterized in that each printer station 19, 19*a*, 19*b*, 19*c* has container gripping and/or holding means 13, each of which grips a container 1, 1*a* presented at a container inlet 18, and moves it into a printing position and holds it there, at least during the printing process.

Still another feature or aspect of an embodiment is believed at the time of the filing of this patent application to possibly reside broadly in the device, characterized in that the at least one print head 3 of each printer station 19*a*, 19*b* is inclined with respect to the vertical machine axis MA such that in the interior 5 of the at least one print head 3 along the printing area 4.1 there is the most uniform possible distribution of the pressure exerted by the ink that results from the pressure of the column of fluid of the ink and from the centrifugal force produced by the rotating rotor 2.

A further feature or aspect of an embodiment is believed at the time of the filing of this patent application to possibly reside broadly in the device, characterized by its realization in the form of a clocked machine 16*d* with at least one printer station 19*d* to which the containers 1, 1*a* are each fed via a conveyor 32 for printing and from which the containers 1, 1*a* are transported away after the printing via the conveyor 32 or an additional conveyor.

Another feature or aspect of an embodiment is believed at the time of the filing of this patent application to possibly reside broadly in the device, characterized in that the conveyor and/or the additional conveyor are a rotor 32 that rotates around a machine axis MA, with brackets or receptacles 28 provided on the periphery of the rotor for the containers 1, 1*a*, and that the at least one printer station 19*d* is provided on the path of movement of the container receptacles 28 or of the containers 1, 1*a* that are held on these receptacles 28 so that it does not move with the rotor 32.

Yet another feature or aspect of an embodiment is believed at the time of the filing of this patent application to possibly reside broadly in the device, characterized in that the containers are held on the container receptacles 28 with their container axis oriented radially with respect to the machine axis MA.

Still another feature or aspect of an embodiment is believed at the time of the filing of this patent application to possibly reside broadly in a method for the operation of the device, characterized in that the print head longitudinal axis DL is in an orientation or is brought into an orientation such that the pressure of the ink resulting from gravity and centrifugal force along the individual nozzles 6 is constant or approximately constant, and that the surface line of the surface to be printed is then oriented parallel to the print head longitudinal axis DL.

A further another feature or aspect of an embodiment is believed at the time of the filing of this patent application to possibly reside broadly in the method for the operation of the device, characterized in that the image to be transferred to the container during a printing process is composed for the specific container from constant components as well as from variable components.

Another feature or aspect of an embodiment is believed at the time of the filing of this patent application to possibly reside broadly in the method for the operation of the device, characterized in that the variable components are graphic information.

Yet another feature or aspect of an embodiment is believed at the time of the filing of this patent application to possibly reside broadly in the method for the operation of the device, characterized in that the variable components are numerical or alpha-numerical components.

Developments of the present application are described in the dependent claims.

The components disclosed in the various publications, disclosed or incorporated by reference herein, may possibly be used in possible embodiments of the present application, as well as equivalents thereof.

Some examples of bottling systems, which may be used or adapted for use in at least one possible embodiment of the present may be found in the following U.S. patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of laser printing arrangements that may possibly be utilized or possibly adapted for use in at least one possible embodiment of the present application may possibly be found in the following U.S. Pat. Nos.: U.S. Pat. No. 4,847,643 issued to Ohmori on Jul. 11, 1989; U.S. Pat. No. 5,294,945 issued to Omura et al. on Mar. 15, 1994; U.S. Pat. No. 5,528,280 issued to Endo et al. on Jun. 18, 1996; U.S. Pat. No. 6,210,778 issued to Poirier et al. on Apr. 3, 2001; U.S. Pat. No. 6,433,810 issued to Katayama et al. on Aug. 13, 2002; and U.S. Pat. No. 6,655,275 issued to Mugrauer on Dec. 2, 2003.

The appended drawings in their entirety, including all dimensions, proportions and/or shapes in at least one embodiment of the present application, are accurate and are hereby included by reference into this specification.

Some examples of laser marking that may possibly be utilized or possibly adapted for use in at least one possible embodiment of the present application may possibly be found in the following U.S. patents: U.S. Pat. No. 6,429,889 issued to Murokh on Aug. 6, 2002; U.S. Pat. No. 6,483,073 issued to Tenderly on Nov. 19, 2002; U.S. Pat. No. 6,489,985 issued to Brodsky et al. on Dec. 3, 2002; U.S. Pat. No. 6,613,161 issued to Zheng et al. on Sep. 2, 2003; U.S. Pat. No. 6,627,299 issued to Feng et al. on Sep. 30, 2003; and U.S. Pat. No. 6,683,637 issued to Corbett on Jan. 27, 2004.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of ink jet printing apparatus and methods that may possibly be utilized or possibly adapted for use in at least one possible embodiment of the present application may possibly be found in the following U.S. patents: U.S. Pat. No. 6,582,047 issued to Koitabashi et al. on Jun. 24, 2003; U.S. Pat. No. 6,623,093 issued to Takahashi et al. on Sep. 23, 2003; U.S. Pat. No. 6,625,351 issued to Cox et al. on Sep. 23, 2003; U.S. Pat. No. 6,652,055 issued to Oikawa on Nov. 25, 2003; U.S. Pat. No. 6,669,767 issued to Blease et al. on Dec. 30, 2003; and U.S. Pat. No. 6,688,739 issued to Murray on Feb. 10, 2004.

Some examples of corona elements that may possibly be utilized or adapted for use in at least one possible embodiment may possibly be found in the following U.S. patents: U.S. Pat. No. 6,951,992, entitled "Corona and static electrode assembly"; U.S. Pat. No. 7,151,902, entitled "Toner transfer technique"; U.S. Pat. No. 6,957,030, entitled "Method and apparatus for making signs"; U.S. Pat. No. 7,153,646, entitled "Photothermographic material"; and U.S. Pat. No. 7,155,150, entitled "Method and apparatus for developing a latent image using toner grains constituting a developer".

All, or substantially all, of the components and methods of the various embodiments may be used with at least one embodiment or all of the embodiments, if more than one embodiment is described herein.

Some examples of screen printing apparatus that may possibly be utilized or possibly adapted for use in at least one possible embodiment of the present application may possibly be found in the following U.S. patents: U.S. Pat. No. 5,374,449 issued to Bühlmann et al. on Dec. 20, 1994; U.S. Pat. No. 5,722,321 issued to Szyszko et al. on Mar. 3, 1998; U.S. Pat. No. 6,591,745 issued to Miyahara et al. on Jul. 15, 2003; U.S. Pat. No. 6,601,502 issued to Kamen et al. on Aug. 5, 2003; U.S. Pat. No. 6,619,197 issued to Murakami et al. on Sep. 16, 2003; and U.S. Pat. No. 6,659,005 issued to Takahashi et al. on Dec. 9, 2003.

Some examples of apparatus and methods for the drying and/or hardening of ink that may possibly be utilized or adapted for use in at least one possible embodiment may possibly be found in the following U.S. patents: U.S. Pat. No. 6,493,018, entitled "Wide format thermal printer"; U.S. Pat. No. 6,957,030, entitled "Method and apparatus for making signs"; U.S. Pat. No. 4,970,528, entitled "Method for uniformly drying ink on paper from an ink jet printer"; U.S. Pat. No. 6,312,123, entitled "Method and apparatus for UV ink jet printing on fabric and combination printing and quilting thereby"; and U.S. Pat. No. 6,857,737, entitled "UV ink printed graphic article".

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

All of the patents, patent applications and publications recited herein, and in the Declaration attached hereto, are hereby incorporated by reference as if set forth in their entirety herein.

Some examples of computer systems that may possibly be utilized or possibly adapted for use in at least one possible embodiment of the present application may possibly be found in the following U.S. patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of heater arrangements that may possibly be utilized or possibly adapted for use in at least one possible embodiment of the present application may possibly be found in the following U.S. patents: U.S. Pat. No. 6,404,421 issued to Meijler et al. on Jun. 11, 2002; U.S. Pat. No. 6,515,264 issued to Toya et al. on Feb. 4, 2003; U.S. Pat. No. 6,548,786 issued to Takizawa et al. on Apr. 15, 2003; U.S. Pat. No. 6,555,796 issued to Cusack on Apr. 29, 2003; U.S. Pat. No. 6,633,727 issued to Henrie et al. on Oct. 14, 2003; and U.S. Pat. No. 6,677,557 issued to Ito et al. on Jan. 13, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 10 2006 001 223.2, filed on Jan. 10, 2006, having inventor Volker TILL, and DE-OS10 2006 001 223.2 and DE-PS10 2006 001 223.2, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

U.S. patent application Ser. No. 11/621,853, now abandoned, filed on Jan. 10, 2007, having inventor Volker TILL, and title "BEVERAGE BOTTLING PLANT FOR FILLING BEVERAGE BOTTLES WITH A LIQUID BEVERAGE, WITH AN INFORMATION ADDING ARRANGEMENT FOR ADDING INFORMATION RELATING TO THE BEVERAGE BOTTLES, AND A METHOD OF OPERATING THE BEVERAGE BOTTLING PLANT", and its corresponding Federal Republic of Germany Patent Application No. 10 2006 001 204.6, filed on Jan. 10, 2006, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of centering devices for bottle handling devices which may possibly be utilized or adapted for use in at least one possible embodiment may possibly be found in U.S. Ser. No. 10/813,657, entitled "A beverage bottling plant for filling bottles with a liquid beverage filling material, and an easily cleaned lifting device in a beverage bottling plant" filed on Mar. 30, 2004; Ser. No. 10/786,256, entitled "A beverage bottling plant for filling bottles with a liquid beverage filling material, and a container filling lifting device for pressing containers to container filling machines", filed on Feb. 25, 2004; and U.S. Ser. No. 10/865,240, filed on Jun. 10, 2004. The above applications are hereby incorporated by reference as if set forth in their entirety herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of position sensors or position sensor systems that may be used or adapted for use in at least one possible embodiment of the present invention may be found in the following U.S. patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of apparatus and methods for electrostatic charging that may possibly be utilized or adapted for use in at least one possible embodiment may possibly be found in the following U.S. patents: U.S. Pat. No. 6,951,377, entitled "Inside printing of flexible packages"; U.S. Pat. No. 6,981,767, entitled "Printed item having an image with a high durability and/or resolution"; U.S. Pat. No. 7,147,980, entitled "Toner and image forming apparatus"; U.S. Pat. No. 7,150,412, entitled "Method and apparatus for electrostatic spray"; and U.S. Pat. No. 7,153,622, entitled "Electrostatic charge image developing toner, producing method therefor, image forming method and image forming apparatus utilizing the toner, construct and method for making the construct".

The embodiments of the present application described herein above in the context of the preferred embodiments are not to be taken as limiting the embodiments of the present application to all of the provided details thereof, since modifications and variations thereof may be made without departing from the spirit and scope of the embodiments of the present application.

AT LEAST PARTIAL NOMENCLATURE

1, 1*a* Bottle
1.1 Bottle mouth
1.2 Bottle bottom
2 Printed impression
2.1 Line
3 Print head
4 Housing
4.1 Housing segment
5 Housing interior
6 Individual nozzles on the housing segment 4.1
7 Opening
8 Electrode
9 Electronic control device
10 Dot
11, 11*a* Printer station
12 Roller
13 Clamping holder
14 Support element
15 Corona element
16, 16*a*, 16*b*, 16*c*, 16*d* Machine
17 Conveyor
18 Bottle inlet
18.1 Inlet star wheel
19, 19*a*, 19*b*, 19*c*, 19*d* Printer station
20 Rotor
20.1 Rotor element
21 Bottle outlet
21.1 Outlet star wheel
22 Shaft
23 Bearing support bracket
24 Motor
25 Axis of rotation
26 Carrier for print head or print head array
27 Roller
28 Clamping holder
29 Support element
30 Roller
31 Drive or motor
32 Rotor
33 Channel
A Rotational movement of container
B Pivoting movement of the print head array
C Direction of transport
D Direction of rotation of the rotor
FA Bottle axis
DA Printer station axis
DE Printing plane
DL Print head longitudinal axis
MA Machine axis
α Angle of inclination of the print head longitudinal axis from the vertical
β Angle of inclination of the bottle axis FA from the vertical
γ Angle of inclination of the axes of the individual jets 6 from the vertical

What is claimed is:

1. A container-printing arrangement configured to print graphic, numeric, and/or alpha-numeric information or an image directly on an external surface of a container comprising a bottle or similar container, said container-printing arrangement comprising:

at least one electrostatic print head comprising a housing configured to contain printing liquid therein;

said housing comprises a plurality of openings configured to dispense printing liquid in a controlled manner directly onto an external surface of a container;

said at least one electrostatic print head comprises a plurality of electrodes, each paired with and disposed adjacent to a corresponding one of said openings;

a container handling arrangement being configured to dispose a container adjacent said at least one electrostatic print head to permit dispensing of printing liquid directly onto an external surface of a container;

said plurality of openings being disposed such that at least one of said openings is disposed at a greater height than at least one other of said openings; and an arrangement configured to rotate a first of said at least one print head about a machine axis such that a greater centrifugal force is generated at said at least one of said openings disposed at a greater height than said at least one other of said openings such that the difference in pressure in said plurality of said openings between said at least one of said openings disposed at a greater height than said at least one other of said openings being configured to compensate for the difference in the pressure caused by gravity at said plurality of openings of said at least one of said openings disposed at a greater height than said at least one other of said openings.

2. The container-printing arrangement according to claim 1, wherein:

said at least one electrostatic print head has a print head longitudinal axis;

said openings are located in a row one after another along said print head longitudinal axis;

said container-printing arrangement is configured to relatively move a container to be printed and said at least one print head during printing, and at least one of (A) and (B):

(A) said container handling arrangement is configured to rotate a container to be printed around its container axis; and (B) said container-printing arrangement comprises a moving arrangement configured to move said at least one print head relative to a container to be printed; and said openings define a printing area, the length of which is equal to or greater than the width of printed information or an image extending in the direction of a container axis.

3. The container-printing arrangement according to claim 2, wherein:

said container-printing arrangement comprises a computer control device configured to control the operation of said openings, said container handling arrangement, and said moving arrangement;

said container-printing arrangement comprises one of: at least two print heads and at least three print heads, and said print heads are configured to print a multiple-color image on containers; and said print heads are configured to be disposed offset from one another, and said print heads can each be moved for printing into a printing position or into a printing plane that defines the printing position.

4. The container-printing arrangement according to claim 3, wherein:

said container handling arrangement comprises a container gripping device having a longitudinal axis;

said container gripping device is configured to grip a container such that the axis of the container is coaxial to the longitudinal axis of said container gripping device;

said container gripping device is configured to be disposed, at least during the printing process, such that the longitudinal axis of said container gripping device is parallel to a horizontal plane or encloses an angle with the horizontal plane; and said print head, at least during the printing process, is configured to be oriented above the surface of a container to be printed.

5. The container-printing arrangement according to claim 4, wherein:

said container-printing arrangement comprises a container inlet and a container outlet;

said container gripping device is configured to grip a container at said container inlet and then move the container into a printing position and hold the container in the printing position during the printing process, and then release the container at said container outlet;

said container gripping device comprises a clamping holder and said container handling arrangement comprises at least one support and/or centering element;

said clamping holder and said at least one support and/or centering element are configured to hold or chuck a container therebetween, at least during the printing process, to grip or fix the container in the printing position; and said print head is configured to be disposed, at least during the printing of a container having a conical external surface, such that said print head longitudinal axis encloses an angle, with an axis of the container or with the longitudinal axis of said container gripping device, that is equal or approximately equal to one-half of a conical angle of the conical external surface of the container.

6. The container-printing arrangement according to claim 5, in combination with a rotor configured to be rotated about a vertical machine axis to move containers, wherein:

a plurality of the container-printing arrangements are supported on said rotor and disposed about the periphery thereof;

said at least one clamping holder is configured to hold a container in the vicinity of a mouth or neck of the container;

said print heads can be adjusted for the printing on a container surface;

said container handling arrangement comprises at least one spacer element configured to space said print heads at a distance from a container surface to be printed;

said container-printing arrangement comprises a spacing measurement system for the setting and/or regulation during the printing process of the distance between said print heads and a container surface to be printed;

said container-printing arrangement comprises an arrangement for drying or hardening of pigment-containing liquid applied to a surface of a container by heat and/or UV radiation;

said container gripping device is configured to be disposed such that the longitudinal axis thereof, at least during the printing process, is one of:

oriented radially or approximately radially with respect to the vertical machine axis of said rotor;

inclined with respect to the vertical machine axis of said rotor; and oriented tangentially or approximately tangentially to a direction of rotation of said rotor;

said print heads are inclined with respect to the vertical machine axis such that, during rotation of said rotor, any pressures on printing liquid at said openings generated by gravity and centrifugal force are caused to essentially offset one another to maintain a constant or approximately constant pressure at said openings;

said container-printing arrangement and rotor combination comprises a clocked machine;

said container gripping devices are disposed on the periphery of said rotor to be moved by said rotor along a path of movement;

said container-printing arrangements are disposed stationary about said rotor along the path of movement of said container gripping devices;

said container gripping devices are configured to hold containers such that the container axes are oriented radially with respect to the vertical machine axis;

the container-printing arrangement is configured to print onto a container consisting of one of: a glass bottle, a plastic bottle, and a PET bottle;

said housing comprises a space therein configured to contain printing liquid;

each of said electrodes is disposed to project into said space in said housing each of said electrodes is configured and disposed to end immediately adjacent its corresponding opening;

said openings have a cross-sectional size configured to maintain surface tension of printing liquid at said openings to thereby minimize leakage of printing liquid therefrom upon said openings not being in use to dispense printing liquid;

said electrodes are configured to have a polarity and/or potential which differs from the polarity and/or the potential of said print head or of the printing liquid to produce electrostatic forces which define the quantity of printing liquid to be dispensed from one or a group of said openings; and each of said electrodes is elongated or substantially needle-shaped, and is disposed essentially co-axially with its corresponding opening.

7. The container-printing arrangement according to claim 1, wherein the container-printing arrangement is configured to print onto a container consisting of one of: a glass bottle, a plastic bottle, and a PET bottle.

8. The container-printing arrangement according to claim 1, wherein:

said housing comprises a space therein configured to contain printing liquid; and each of said electrodes is disposed to project into said space in said housing.

9. The container-printing arrangement according to claim 8, wherein each of said electrodes is configured and disposed to end immediately adjacent to its corresponding opening.

10. The container-printing arrangement according to claim 9, wherein:

said openings have a cross-sectional size configured to maintain surface tension of printing liquid at said openings to thereby minimize leakage of printing liquid therefrom upon said openings not being in use to dispense printing liquid; and said electrodes are configured to have a polarity and/or potential which differs from the polarity and/or the potential of said print head or of the printing liquid to produce electrostatic forces which define the quantity of printing liquid to be dispensed from one or a group of said openings.

11. The container-printing arrangement according to claim 1, wherein said openings are disposed in a row, one behind the other, in a direction.

12. The container-printing arrangement according to claim 11, comprising a rotary structure configured to rotate said first print head and wherein said openings are disposed in a row which row is disposed at an angle to the vertical such that, upon rotating, at a rotation speed generated by said rotary structure, of said at least one of the openings being disposed at a greater height than said at least one other of the openings is disposed further away from another axis of said openings;

said rotary structure being configured to rotate said print head at a greater centrifugal force on said at least one of the openings being disposed at a greater height than said at least one other of the openings.

13. The container-printing arrangement according to claim 12, wherein said rotary structure is adjustable to substantially cancel out any substantial difference between pressure in said at least one of the openings being disposed at a greater height than said at least one other of the openings.

14. The container-printing arrangement according to claim 12, wherein said angle is configured to provide said difference in centrifugal force.

15. A container-printing arrangement configured to print graphic, numeric, and/or alpha-numeric information or an image directly on an external surface of a container comprising a bottle or similar container, said container-printing arrangement comprising:

at least one electrostatic print head comprising a housing configured to contain printing liquid therein;

said housing comprises a plurality of openings configured to dispense printing liquid in a controlled manner directly onto an external surface of a container;

said at least one electrostatic print head comprises a plurality of electrodes, each paired with and disposed adjacent to a corresponding one of said openings;

a container handling arrangement being configured to dispose a container adjacent said at least one electrostatic print head to permit dispensing of printing liquid directly onto an external surface of a container;

a rotor configured to be rotated about a vertical machine axis to move containers, wherein:

said at least one print head being supported on said rotor; and said direction of said print heads being inclined at a predetermined angle with respect to the vertical machine axis such that, during rotation at a predetermined speed of said rotor, differences in pressures on printing liquid at said openings generated by gravity and also centrifugal force generated by the rotation of said rotor are caused to essentially offset one another to maintain a constant or approximately constant pressure at said openings.

16. A method of printing on an external surface of a bottle or similar container using a container-printing arrangement comprising: at least one electrostatic print head comprising a housing configured to contain printing liquid therein, which said housing comprises a plurality of openings, in a row, configured to dispense printing liquid in a controlled manner onto an external surface of a container; and a plurality of electrodes, each paired with and disposed adjacent to a corresponding one of said openings, said method comprising the steps of:

positioning said at least one electrostatic print head and then said row of openings at a non-zero, acute angle with respect to the vertical, adjacent to a container such that a first of said openings is higher than a second of said openings thereby generating a higher pressure by gravity at said second opening than said first opening;

rotating said print head and said container about a machine axis and generating a higher pressure by centrifugal force at said first opening than said second opening; and printing by activating at least one of said electrodes and dispensing printing liquid out through the openings which correspond to the activated electrodes and directly onto the external surface of said container.

17. The method according to claim 16, wherein said method further comprises establishing a constant or substantially constant pressure of the printing liquid at said openings resulting from gravity and centrifugal force along said openings.

18. The method according to claim 17, wherein:

said at least one electrostatic print head has a print head longitudinal axis, and said method further comprises orienting said print head longitudinal axis essentially parallel to said external surface of said container to be printed; and said step of printing on said container comprises printing an image comprising constant components and variable components, which variable components comprise one of: graphic information and numerical or alpha-numerical information.

19. The method according to claim 18, wherein said electrodes have a polarity and/or potential which differs from the polarity and/or the potential of said print head or of the printing liquid, and wherein said step of printing on said container comprises activating one or more of said electrodes, either individually or in groups, with an electrical voltage, and thereby producing electrostatic forces which define the quantity of printing liquid to be dispensed from one or a group of said openings, and thereby causing printing liquid to exit from one or a group of said openings;

said container-printing arrangement is configured to relatively move a container to be printed and said at least one print head during printing, and said method comprises one of (A), (B), and (C):

(A) rotating said container to be printed around its container axis;

(B) moving only said at least one print head relative to a container to be printed; and (C) moving said container to be printed around its container axis and moving said at least one print head relative to the machine axis;

gripping a container between a clamping holder of a container gripping device and at least one support and/or centering element of a container handling arrangement, such that the axis of the container is coaxial to the longitudinal axis of said container gripping device;

positioning said at least one electrostatic print head above the surface of a container to be printed; and positioning, at least during the printing of a container having a conical external surface, said print head such that said print head longitudinal axis encloses an angle, with an axis of the container or with the longitudinal axis of said container gripping device, that is equal or approximately equal to one-half of the conical angle of the conical external surface of the container;

said container printing arrangement is in combination with a rotor configured to be rotated about a vertical machine axis to move containers, wherein said method further comprises:

supporting a plurality of the container-printing arrangements on said rotor about the periphery thereof;

holding a container in the vicinity of a mouth or neck of the container using said clamping holder;

spacing said print heads at a distance from a container surface to be printed using at least one spacer element;

setting and/or regulating during the printing process the distance between said print heads and a container surface to be printed using a spacing measurement system;

drying or hardening of pigment-containing liquid applied to a surface of a container by heat and/or UV radiation;

orienting the longitudinal axis of said container gripping device, at least during the printing process, one of:

radially or approximately radially with respect to the vertical machine axis of said rotor;

at an incline with respect to the vertical machine axis of said rotor; and tangentially or approximately tangentially to a direction of rotation of said rotor;

holding containers such that the container axes are oriented radially with respect to the vertical machine axis using said container gripping devices;

said step of printing onto a container comprises printing onto one of: a glass bottle, a plastic bottle, and a PET bottle; and said housing comprises a space there n configured to contain printing liquid, and each of said electrodes .s disposed to project into said space in said housing, and said method further comprises activating each electrode individually using a polarity and/or potential which differs from the polarity and/or the potential of said print head or of the printing liquid to produce electrostatic forces which define the quantity of printing liquid to be dispensed from one or a group of said openings.

* * * * *